US005971422A

United States Patent [19]

Anderson et al.

[11] Patent Number: 5,971,422

[45] Date of Patent: Oct. 26, 1999

[54] SNOWBOARD BOOT AND BINDING APPARATUS

[75] Inventors: Erik Anderson; Jeff Sand, both of San Francisco, Calif.

[73] Assignee: Switch Manufacturing, San Francisco, Calif.

[21] Appl. No.: 09/244,271

[22] Filed: Feb. 3, 1999

Related U.S. Application Data

[60] Division of application No. 08/489,167, Jun. 9, 1995, Pat. No. 5,890,730, which is a continuation-in-part of application No. 08/292,485, Aug. 18, 1984, Pat. No. 5,520,406.

[51] Int. Cl.[6] ..... A63C 9/02

[52] U.S. Cl. ..... 280/624; 280/14.2

[58] Field of Search ..... 280/14.2, 607, 280/618, 624, 625, 613, 633, 634; 441/70

[56] References Cited

U.S. PATENT DOCUMENTS

| | | | |
|---|---|---|---|
| 3,606,370 | 9/1971 | Spademan | 280/624 |
| 4,360,219 | 11/1982 | Spademan | 280/624 |
| 4,728,115 | 3/1988 | Pozzobon et al. | 280/613 |
| 4,973,073 | 11/1990 | Raines et al. | 280/14.2 |
| 5,035,443 | 7/1991 | Kinchloe | 280/14.2 |
| 5,054,807 | 10/1991 | Fauvet | 280/607 |
| 5,085,455 | 2/1992 | Bogner et al. | 280/14.2 |
| 5,143,396 | 9/1992 | Shaanan et al. | 280/607 |
| 5,145,202 | 9/1992 | Miller | 280/14.2 |
| 5,207,446 | 5/1993 | Arnulf et al. | 280/634 |
| 5,299,823 | 4/1994 | Glaser | 280/607 |
| 5,362,087 | 11/1994 | Agid | 280/14.2 |
| 5,577,757 | 11/1996 | Riepl et al. | 280/624 |

FOREIGN PATENT DOCUMENTS

| | | | |
|---|---|---|---|
| 2689776 | 10/1993 | France | 280/14.2 |
| 236147 | 7/1911 | Germany | 280/624 |
| 4311630 | 8/1994 | Germany | 280/14.2 |
| 79/00798 | 10/1979 | WIPO | 280/624 |

*Primary Examiner*—J. J. Swann
*Assistant Examiner*—F. B. Vanaman
*Attorney, Agent, or Firm*—David H. Jaffer

[57] ABSTRACT

A binding assembly for attaching a boot to a snowboard, designed in a manner to avoid cavities that can accumulate ice and snow and defeat its operation. The system includes first and second boot mounted bales in the form of rigid loops that extend from each side of the boot soles, and a pair of bindings attached to the snowboard. Each binding has a base including elongated, slotted holes located on the circumference of a circle through which bolts are placed to secure the base to the snowboard with a friction washer therebetween. The elongated holes allow for rotational adjustment of the binding. A hook-shaped structure extends from one side of the base with the hook facing outward. On the opposite side of the base is a camming structure with a downward and outwardly sloping surface ending in a bale-receiving notch. A spring loaded latch is pivotally mounted outboard and above the notch and includes a lever with a generally outwardly protruding handle on one side of the lever pivot axis, and a bale latching portion on the other side of the pivot. By placing the first bale over the hook and then thrusting the second bale downward against the latching portion and into engagement with the camming structure, the first bale is drawn into engagement with the hook as the second bale is guided by the sloping surface into the notch where it is retained by the latch. In order to release the binding, the user simply rotates the latch upward to free the bales.

8 Claims, 16 Drawing Sheets

139
144
116
138
135
143
52
26
R2
123
98
72
112
60
125
28
137
74
118
44

28
74
127

154
140
148
150
142
146
152
160
144
156
166
162
158
60
130
165
164

SNOWBOARD BOOT AND BINDING APPARATUS

This application is a divisional of application Ser. No. 08/489,167, filed Jun. 9, 1995, now U.S. Pat. No. 5,890,730, which is, in turn a continuation-in-part of application Ser. No. 08/292,485, filed Aug. 18, 1994, now U.S. Pat. No. 5,520,406.

BACKGROUND OF THE INVENTION

1. Field of the Invention

The present invention relates generally to boot binding assemblies, and more particularly to a binding assembly for securing boots to a snow board, including bale elements for attachment to the boots, the elements in turn engageable with a pair of bindings for attachment to the snow board, and the bindings being designed with structural elements that avoid cavities that can accumulate ice and snow.

2. Description of the Prior Art

Since the advent of the snowboard, numerous types of bindings have been invented in order to properly secure a rider's boots, but as will be described in the following, these devices leave some problems unsolved. The snowboard is an elongated structure with upturns at one or both ends. It is normally shorter and wider than the more typical snow ski conventionally used in pairs. Instead of having the feet bound on separate skis and pointing forward, they are both bound to a single snow board and usually face generally towards the sides, although some adjustment of their position is a useful feature. At first glance, the use of the board appears similar to a small surf board. A significant difference is that the riders feet are simply placed on a surf board whereas the snow board system requires the rider's feet to be bound to the board for maximum maneuverability. Current snow board bindings are of two major categories, for use with soft boots or hard boots. The choice of boot type depends on the riding style, with the soft boot used for freestyle and freeriding, and hard boots for alpine and racing. One type of soft board binding uses two or three straps attached to a plate mounted to the snow board. The straps are wrapped over the instep of the boot, around the ankle and then fastened together with ratcheting buckles. This kind of binding causes severe difficulties for a number of reasons, including the fact that at least one boot must be removed from its binding whenever the skier needs propulsion on level or uphill conditions, such as when making one's way to a ski lift. In order to emphasize this particular problem, consider a typical scenario. First the rider secures the front foot to the board. In order to do so, one sits in the snow, reaches down to clear snow that has collected in the binding or on the bottom of the boot, and then opens the now loose series of straps and puts the boot in the binding. With gloved hands, one has to engage a series of ratcheting mechanical buckles to secure the front boot. Once the front boot is secured the rider is ready to enter the ski lift to the top of the mountain. Arriving at the top, the rear boot must be mounted to the board in a similar fashion. When the skier reaches the bottom of the hill, the rear boot is released from the binding and the process is repeated, over and over again for every run, which can amount to an average of 40 to 50 times in a day.

The problem of exiting from the bindings is not only a nuisance compounded by the cold and clumsiness of gloved hands, but it is also dangerous. During the 1992–1993 season it was reported in the Tahoe area that two snowboarders died from suffocation in the heavy powder. In many such emergency situations it is extremely important to be able to quickly exit from the board in order to gain maneuverability. An additional problem with the strap type of bindings is that pressure from the straps is transferred to the users foot, particularly while riding the lift. This pressure over the day causes muscle fatigue and pain.

Attempts have been made to design "step-in" snow board bindings, examples of which will be described in the following discussion. A problem with these attempts is that they consist of complex mechanical apparatus containing pockets and crevices which accumulate ice and snow in a way that causes operational failure or difficulties.

The need for ease of entry and quick exit for safety reasons was discussed above. In addition, one might wonder about a possible need for automatic release from a snow board such as is generally incorporated in the more conventional two ski apparatus. The answer to this is that with conventional snow skis, the users feet are bound to separate skis of lengthy dimensions. In a fall, the possibilities for entanglement and various leverages to the limbs is great. In contrast, both feet are bound to a single relatively short board in the snow board application, a condition that does not contain nearly as much probability of applying damaging leverage to a skiers limbs. Also, one might wonder if the principles used in conventional snow skies would be applied to snow board bindings. The answer again, is that the two applications are significantly different. For example, the conventional snow ski is used along with rigid boots, requiring a different type of binding than that required for use with the soft snow ski boot. Also, the release mechanisms in conventional snow skis dominate their design and are not useful with snow boards because the boots on a snow board are mounted generally transverse to the board length, a condition that can not generate the leverage required to release such a binding.

From the above discussion, it is clear that one of the design factors in a successful snow board binding is ease of entry and exit. Other factors include simplicity, low cost and reliability. One example of a binding design that addresses the problem of ease of entry and exit is the disclosure in U.S. Pat. No. 4,728,118 by Pozzobon et al. describing a binding that can be entered with a downward thrust of the foot. The bottom of the boot has cavities to match upwardly protruding captivating extensions attached to the board, one of which is slidably mounted and spring loaded to allow the binding protrusions to snap in place in the boot. One disadvantage of this approach is the presence of the cavity in the bottom of the boot which must be kept free of snow and ice buildup in order to function properly. The binding also has numerous springs and slidable parts which, if not carefully designed and manufactured could be susceptible to moisture penetration and jamming due to ice formation.

In U.S. Pat. No. 5,035,443 by Kincheloe there is disclosed a binding composed of a plate mounted to a board having upturned captivating edges forming a socket. A matching mating plate is attached to the bottom of the boot which the user must then align with the socket and slidably make engagement. The locking mechanism in the socket has concealed crevices potentially allowing penetration of moisture which could freeze and render the release mechanism inoperable, as well as the joints between the sliding plate and socket during operation.

Glaser, in U.S. Pat. No. 5,299,823 discloses a binding having a plate mounted to the board with a fixed position longitudinally oriented socket on one side and an oppositely disposed spring loaded slidable socket on the other side. A plate is attached to the boot in a manner similar to Kincheloe with one edge protruding longitudinally from one side of the boot, and an opposing edge from the other side of the boot. In operation, the user places one edge of the plate in the first socket, and forces the opposing edge downward upon the slidable socket which has a tapered edge so that when the user forces the edge of the plate down against the tapered edge, the socket moves away until the opposing edge snaps into the socket. The disadvantage of this design is that snow and ice can form inside the sockets of the binding plate, making full engagement either impossible or difficult. Also, the slidable spring loaded socket has a multitude of springs and interconnecting parts, which again raise the probability of moisture penetration which could freeze and render the mechanism inoperable.

In U.S. Pat. No. 4,973,073 by Raines, a binding is disclosed which is similar to the Glaser invention in that a plate is again attached to the boot with protruding edges on either side. The binding portion attached to the board consists of a separate socket on one side. On the other side, a socket is formed from a spring loaded hinged cap member that snaps into position over the protruding edge of the boot plate when the user forces the boot plate down into position. A disadvantage of this design is that snow buildup can occur in the socket, particularly the hinged portion, and defeat proper operation. In the event that less than full locking is obtained, the device may appear to be secure but could work loose with upward boot pressure causing unwanted ejection.

There is clearly a need for a simple binding mechanism involving few parts that resists the detrimental build up of snow and ice and in which the user can be certain that upon entry, the binding is secure.

Another problem with snowboard binding systems is the need for adjustable support of the riders foot as indicated by the above mentioned use of either soft or hard boots. No current method or boot system exists that will allow a skier to adjust the degree of support to his foot and ankle.

SUMMARY OF THE INVENTION

It is therefore an object of the present invention to provide an improved binding for use with snow boards that provides "step-in" easy entry and retains the user on the board until manually disengaged.

It is another object of the present invention to provide a snow board binding that allows for rapid exit.

It is a further object of the present invention to provide a binding that has few moving parts and is cost effective to manufacture.

It is a still further object of the present invention to provide a binding that is not susceptible to malfunction due to accumulation of ice and snow.

It is another object of the present invention to provide a snow board binding that will not release accidently.

It is another object of the present invention to provide a binding that results in a more uniform distribution of pressure on a users foot.

It is another object of the present invention to provide an apparatus allowing a skier to adjust the amount and angle of support to his feet.

A still further object of the present invention is to provide a secure binding latching mechanism that compensates for binding wear and ice and snow buildup under the boots.

Briefly, a preferred embodiment of the present invention includes a binding assembly for attaching a boot to a snow board, designed in a manner to avoid cavities that can accumulate ice and snow and defeat its operation. The system includes first and second boot mounted bales in the form of rigid loops that extend from each side of the boot soles, and a pair of bindings attached to the snow board. Each binding has a base including elongated, slotted holes for rotatably adjustable mounting to a snow board with a friction washer therebetween. A loop-shaped hooked structure extends from one side of the base with the hook facing outward. On the opposite side of the base is a loop-shaped structure with upright ends having a downward and outwardly sloping camming surface ending in a bale-receiving notch. A spring loaded latch is pivotally mounted outboard from and above the notch, and includes a lever with a generally outwardly protruding handle on one side of the lever pivot axis, and a bale latching portion on the other side of the pivot. By placing the first bale over the hook and then thrusting the second bale downward against the latching portion and into engagement with the camming structure, the first bale is drawn into engagement with the hook as the second bale is guided by the sloping surface into the notch where it is retained by the latch. The bale latching portion has a cam shaped surface providing secure latching in spite of ice or snow buildup or wear. In order to release the binding, the user simply rotates the latch handle upward, freeing the bales.

For adjustable support to the skiers foot, the boot and binding apparatus includes an adjustable boot insert, and a plate or shank on the bottom inside of the boot, the plate interconnected preferably with the bale element. The combination of the plate, and the adjustable boot insert formed around the users foot, gives the skier control over the angle and amount of foot and ankle support.

An advantage of the present invention is that it is easy to enter with only a downward movement of the boot, and to exit with a single motion of a lever fully under user control.

A further advantage of the present invention is that due to the loop shaped structures, there are no cavities to accumulate snow and ice to defeat the proper operation of the binding.

Another advantage of the present invention is its simplicity of structure allowing for economical manufacture.

A further advantage of the present invention is that it results in a more uniformly distributed pressure on the users foot, both during use and in unweighting conditions such as when riding a chair lift, by eliminating the straps of a conventional binding.

A still further advantage of the present invention is the provision of a latch that adjusts for wear and ice and snow buildup under the boots.

DESCRIPTION OF THE PREFERRED EMBODIMENTS

Figure 1:
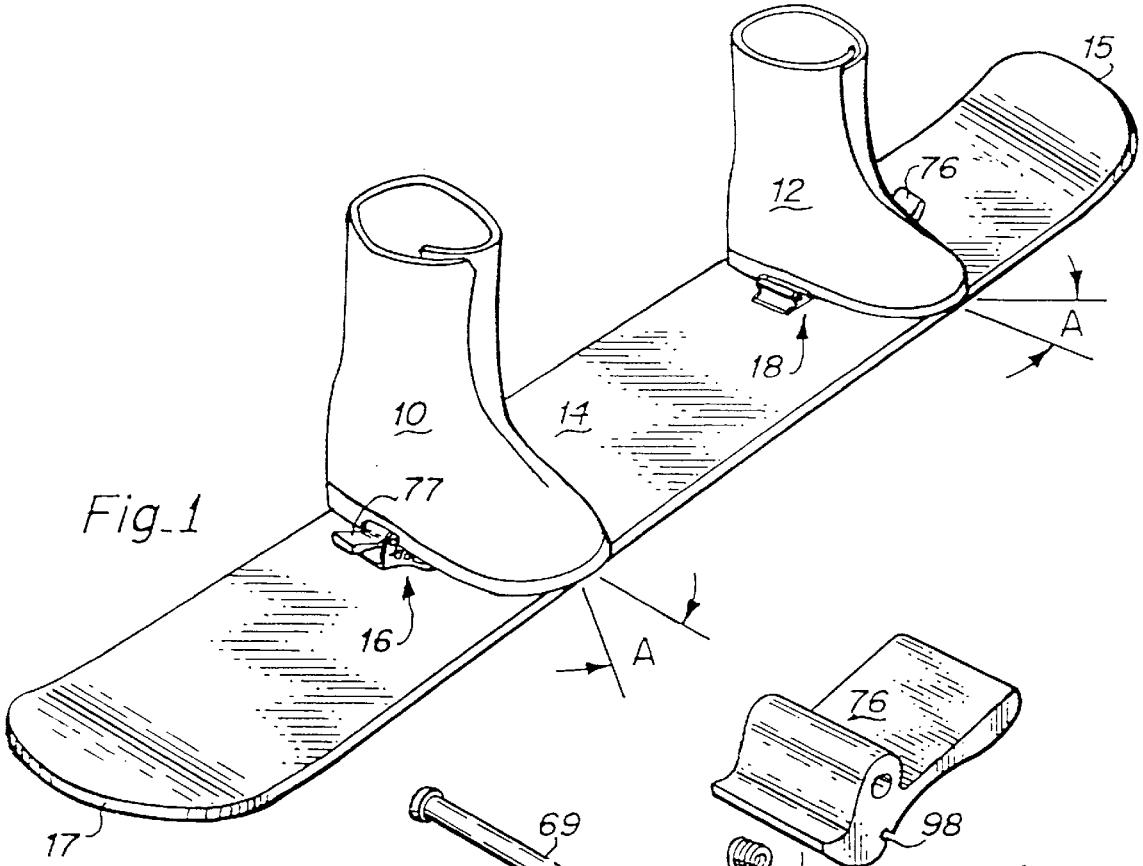
FIG. 1 illustrates the use of a preferred embodiment of the present invention for binding a pair of boots to a snow board.

A preferred embodiment of the present invention is illustrated in use in FIG. 1 wherein boots 10 and 12 are mounted to snow board 14 by way of binding assemblies 16 and 18. The board 14 as shown has an upturned front end 15 and a tail end 17 that optionally may also by turned upward. The boots 10 and 12 are illustrated in the usual transverse position to the length of the board. A skier can quickly and easily release the boots from the bindings by simply pulling upward on the levers 76, 77. Entering the bindings is done by positioning the boot over the binding and stepping downward, causing it to latch into place, a feature fully described in the following detailed description. As will be explained in the following, provision is also provided for adjusting the angle "A" of the boots on the board with toe inward or outward from the strict transverse position shown.

Figure 2:
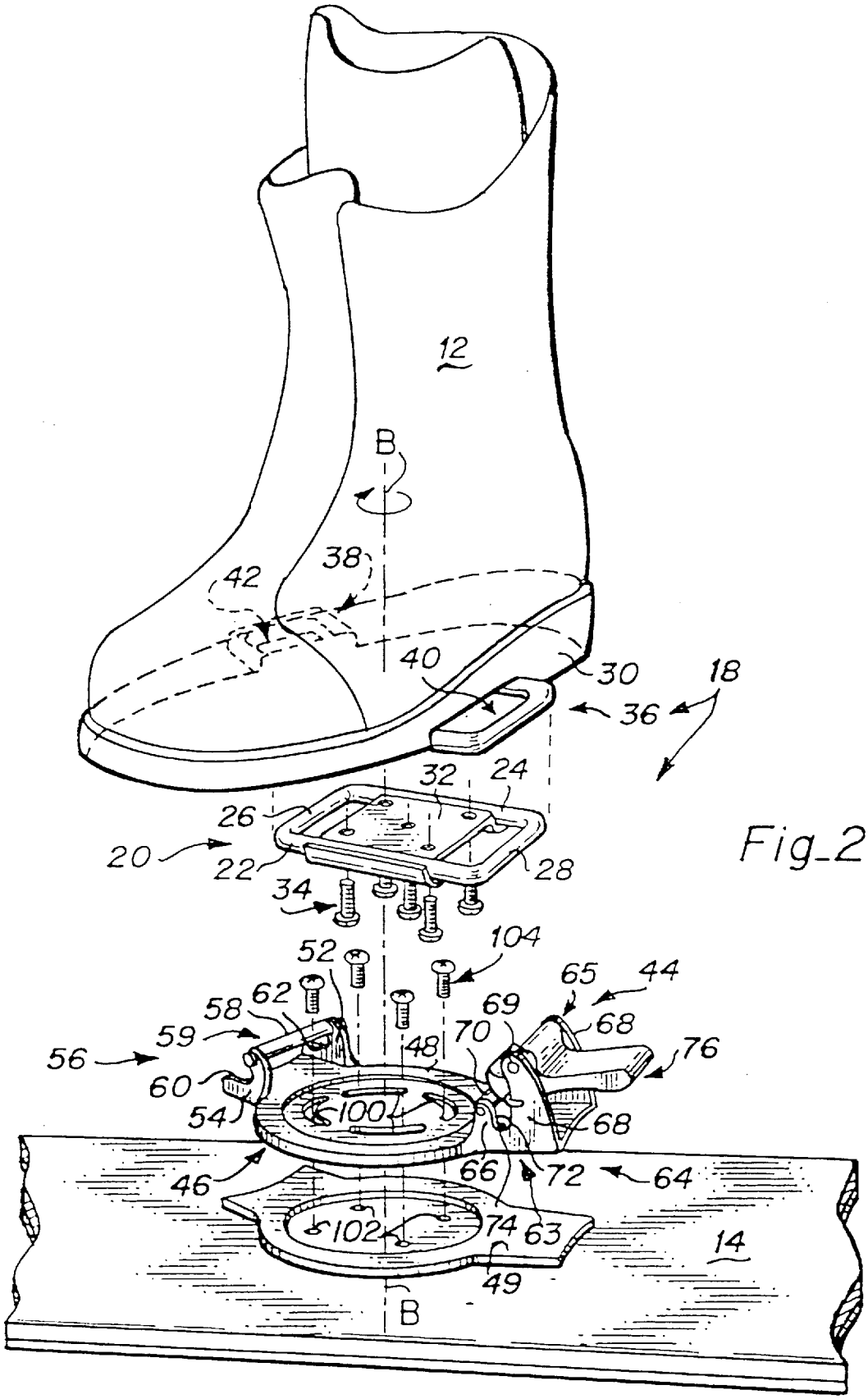
FIG. 2 is an exploded view of the boot bale and binding illustrated in FIG. 1.

FIG. 2 illustrates the details of a preferred embodiment as incorporated in boot 12 and binding assembly 18. Boot 10 and assembly 16 are simply mirror images of the apparatus of FIG. 2 and need not be separately shown. The binding assembly 18 includes a bale assembly 20 and a binding 44. The bale assembly 20 is of approximately rectangular or trapezoidal shape with a front side segment 22 shown somewhat longer than the rear side segment 24, the front and rear segments being interconnected by first and second opposing bale end segments 26 and 28. The length of the front segment 22 relative to the rear segment 24 causes bale segments 26 and 28 to angle out from each other somewhat, the purpose being to orient the segments 26 and 28 substantially parallel to the sides of the boot sole 30. This orientation is preferred for space conserving purposes because any additional protrusions from the boot can be a nuisance when walking. Other orientations are also functional, such as segments 26 and 28 lying parallel to each other, and are included in the spirit of the invention. The bale assembly 20 as shown is bolted to the sole 30 of the boot 12 by a retaining plate 32 secured with bolts 34. The bale assembly 20 is illustrated in position on the boot 12 by the dashed outline on either side of the boot 12 at positions 36 and 38. Of particular note are the substantially rectangular left and right side bale openings 40 and 42. In the preferred embodiment, the bale assemblies 20 are constructed with the segments 26 and 28 having a cylindrical cross section which ensures maximum contact with the binding 44, as will become evident in the following detailed description. The rod structure is an efficient shape, structurally allowing a maximum strength to material gauge ratio. The round cross section is preferred because it is required to make contact with a camming surface and a latch at various angles as it is thrust into the binding, a fact that will be fully illustrated in the figures of the drawing. The bale side segments 22 and 24 perform two important functions, including the creation of a rigid and constant space between the two bale end segments 26 and 28, and providing hold down support for the boot. Other methods of fabricating a retaining plate, bale, and attachment to the sole 30 will be apparent to those skilled in the art, and are included in the spirit of this invention. One alternative would be an integral molded/cast bale and retaining plate captivated within a molded boot sole.

The binding 44 has a base 46 including a frame 48 elevated in the figure to show a gasket 49 providing a friction interface between the frame 48 and board 14 when bolted together by bolts 104 through holes 100 and into tapped holes 102 in the board 14. The frame 48 is shown to have front and rear upward and outwardly arcing hook-shaped members 52 and 54 provided on a first side 56 of base 46 and joined at their tops by a cross bar 58. The hooked members 52 and 54 are configured so as to form bale-receiving recesses 60 and 62. The loop shaped structures formed by the members 52, 54 and cross bar 58 allow for passage of ice and snow through the opening 59. The surfaces of recesses 60 and 62 are designed to be narrow so as to create sufficient pressure against an engaging bale element surface to dislodge any ice or snow deposited thereon. In the preferred embodiment of segments 26, 28, their cross section is circular, resulting in a minimal contact area between each segment 26, 28 and the surfaces 62, 72, a condition resulting in high pressure, causing the segment to efficiently wipe away any ice and snow on the surfaces. On a second side 64 of base 46, approximately opposite the first side 56, the frame 48 is shown bent upwardly and forming a pair of saddle-shapedside members 63, 65, each including an inner upright 66 and an outer upright 68. The inner uprights 66 are joined together at their tops by a cross bar 70 while the outer uprights 68 are joined at their tops by a pivot shaft or pin 69. The outer edges of uprights 66 slope outwardly to form camming surfaces 72 leading into the bale-receiving notches 74. Disposed between uprights 68 and pivotally affixed thereto by pin 69 is a latch 76.

The uprights 66, 68, cross bar 70 and shaft 69 form loop structures similar to the members 52, 54 and cross bar 58, to provide a structure absent of any cavities that can accumulate ice and snow, and the narrow camming surfaces 72 provide a high pressure in contact with the bale element 28 to dislodge any ice or snow therefrom.

The holes 100 are shown in the form of four arcuately shaped slots, positioned along a circumference coaxial with a rotational axis "B", through which bolts 104 are inserted to secure the frame 48 to the board 14. With the bolts 104 loosened, the frame 48 can be rotated to adjust the orientation angle "A" of the boots 10, 12 as was briefly described in reference to FIG. 1. Although the elongated holes as shown are preferred, the holes 100 could be of any number and of various shapes including numerous bolt clearance holes in the frame 48 along a circumference coaxial with axis "B", which would provide for incremental adjustments.

The embodiment of the present invention described in the various figures presents the preferred construction. It will be apparent to those skilled in the art that various modifications could be made which retain the spirit of the invention, which is predominantly the loop shaped structures avoiding cavities that could accumulate ice and snow, and the novel cam latch. These modifications are included in the spirit of the invention. For example, although two upright members 66 and hooked shaped members 52 and 54 are shown, a quantity of one or more could be used to serve the purpose of guiding the bale segments into notched recesses, and these variations should be considered as part of the present invention.

Figure 3:
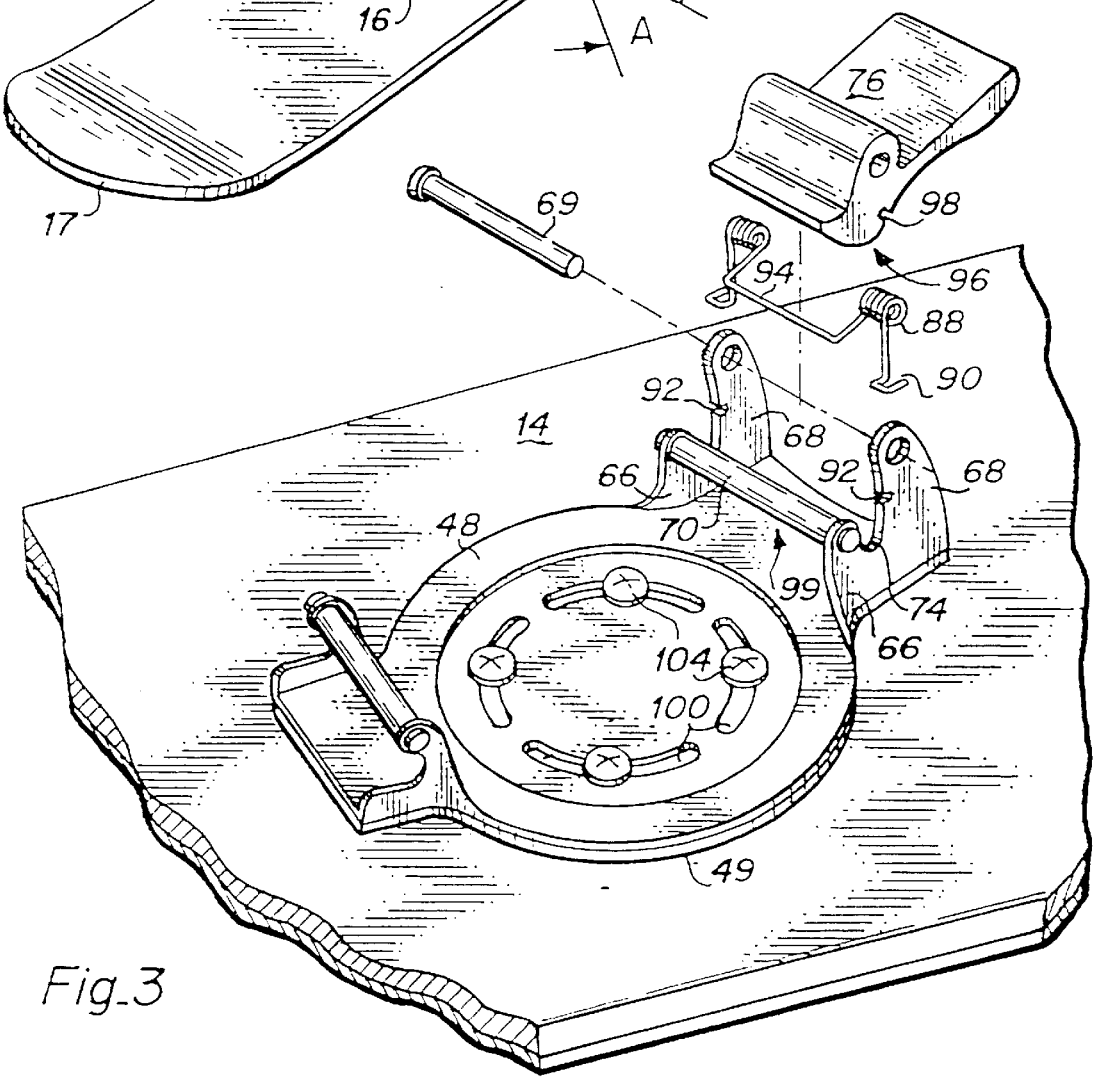
FIG. 3 is an exploded view of the base and latch subassembly illustrated in FIG. 2.

Referring now to FIG. 3, the latch 76, pin 69 and a spring 88 are shown more clearly in an exploded view. The uprights 68 are joined near their tops by the pin 69. The latch 76 and spring 88 are mounted on the pin 69, the spring 88 pretensioned during assembly, functioning to urge the latch 76 into a position resting on the bale element when engaged in the notch 74, as well be fully explained in the following description. When the bale elements are removed from the binding, as in FIGS. 2 and 3, the cross bar 70 conveniently acts as a stop for the latch 76 resting thereon as shown in FIG. 2. This is an optional feature of the present invention. The spring 88 has hooked ends 90 retained in spring retaining slots 92, and a lever portion 94 bearing against the bottom 96 of the latch 76 in groove 98 when assembled.

FIG. 3 also shows the loop shaped structure of cross bar 70 and uprights 66 more clearly, which provide the novel feature of an absence of snow collecting cavities, allowing ice and snow to move freely through the opening 99 under the cross bar 70, and axle 69 and latch 76.

The figure additionally shows the frame 48 bolted to the board 14 with the friction washer 49 sandwiched therebetween.

Figure 4:
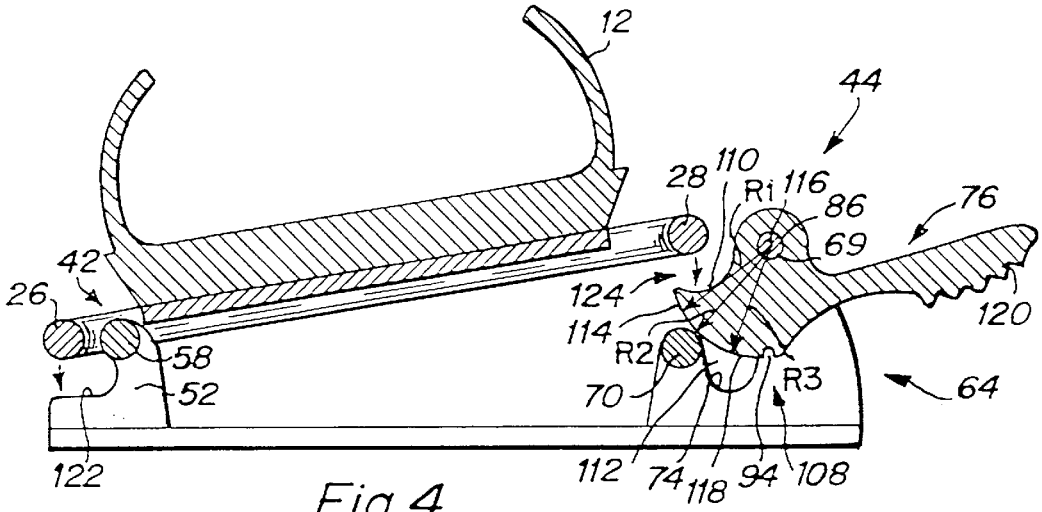
FIG. 4 is a first view of a series of transverse cross-sectional views illustrating various positions of the bale relative to the binding during the engagement process.

FIGS. 4–7 give further detail of the latch 76 and its operation in securing the boot in the binding 44. In general, FIGS. 4–7 illustrate the functional importance of the surfaces 72 in guiding the bale segment 28 downward and outward, guiding its lateral motion so as to allow the bale segment 26 to first rest on surface 122 laterally outside of the hook 52 and cross bar 58, and as the bale segment 28 is forced downward, it is guided first by surface 110 of the latch 76 and then by surface edges 72 laterally outward in a controlled manner, pulling the segment 26 into the hook 52. In further detail now, FIG. 4 shows that the latch 76 has an extension 108 with a trough shaped upper surface 110 and a bale-engaging or latching surface 112. The surface 112 has a compound curvature with a first portion 114 dimensioned at a radius R1 from the rotational axis 116 of the latch 76 defined by the center of the pin 69. The distance R2 to the cross bar is dimensioned somewhat greater than the radius R1 from the axis 116, allowing the extension 108 to move upward and partially past the cross bar 70. The surface 112 has a second portion 118 having a radius R3 from axis 116, R3 being greater than R1. The dimensioning of R2 is further defined so that as the extension 108 is rotated upward, the surface of the lower portion 118 interferes with and rests upon the surface of the cross bar 70, stopping rotation of latch 76 under influence of spring 88. This feature of stopping the latch rotation on the bar 70 is a convenience feature, functioning when the bale segment 28 is removed as shown in FIG. 4. The critical function of the novel dimensioning of the camming surface 112, including the selection of R1 and R3, is for locking the bale segment 28 in the notch 74, as will be explained more fully in the following descriptions. The bale-receiving notch 74 is dimensioned relative to the axis 116 so that when the bale segment 28 is lodged in the notch 74, the second portion 118 of surface 112 is in engagement with the segment 28, locking it in place. Due to the progressively increasing radius of the surface 112 from the axis 116 from R1 to R3, the surface 112 will wedge against the element 28 even if the bale segment 28 is displaced in the notch as a result of ice or snow under the boot or in the notch 74, or in the event of dimensional variations caused by manufacturing tolerances or wear. This important feature will be more fully shown in the following figures of the drawing. As illustrated, the latch 76 also has a handle or lever extension 120 by which a user may rotate the latch counter-clockwise as depicted in FIGS. 4–7 to release the bale segment 28 from the notch 74.

Figure 5:
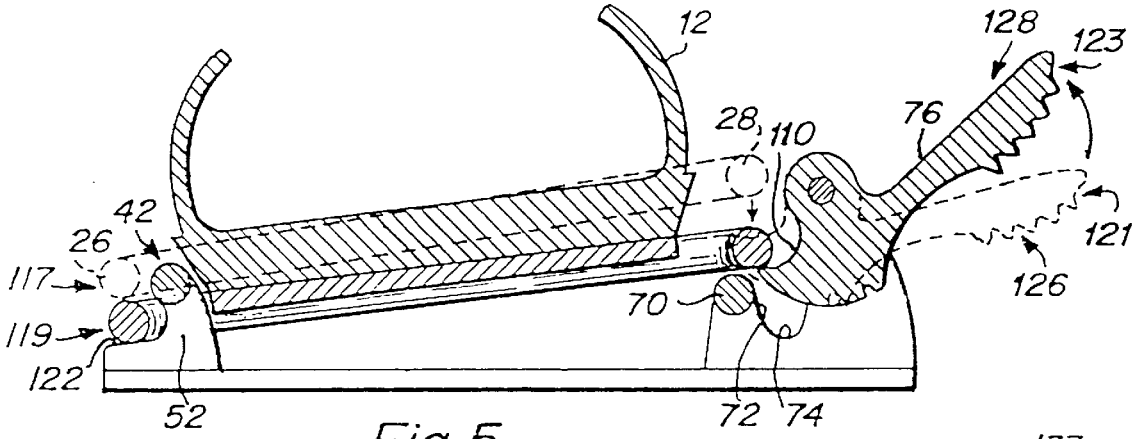
FIG. 5 is a second view of a series of transverse cross-sectional views illustrating various positions of the bale relative to the binding during the engagement process.
Figure 6:
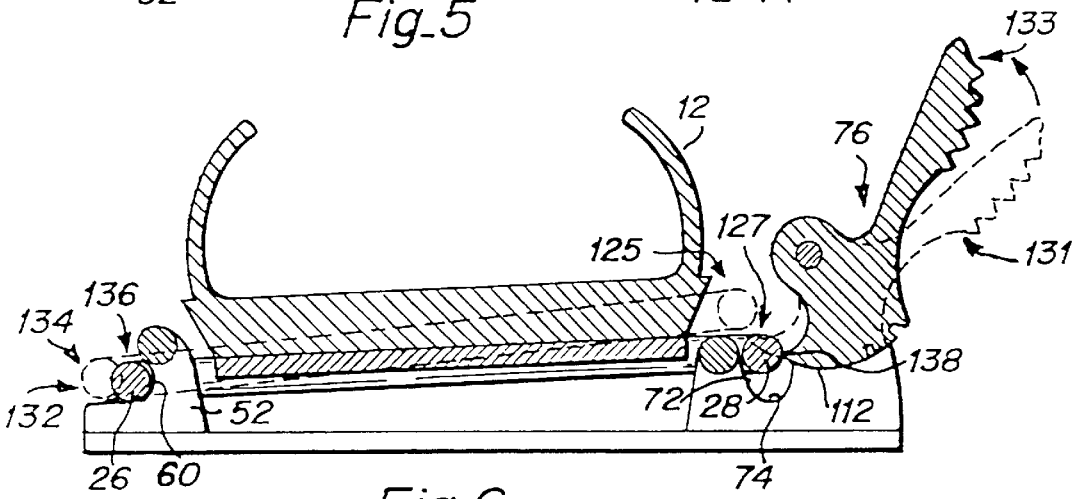
FIG. 6 is a third view of a series of transverse cross-sectional views illustrating various positions of the bale relative to the binding during the engagement process.
Figure 7:
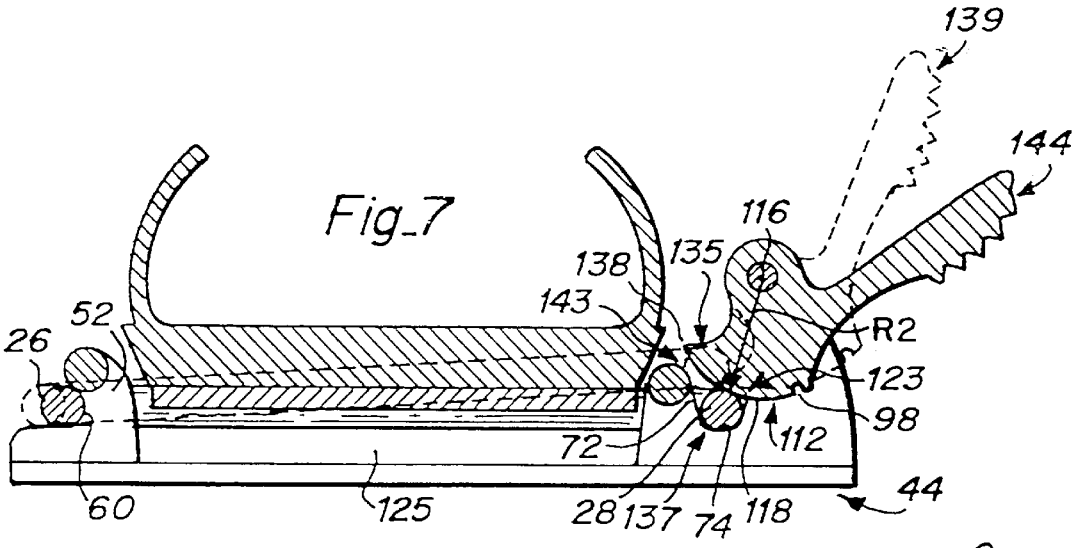
FIG. 7 is a fourth view of a series of transverse cross-sectional views illustrating various positions of the bale relative to the binding during the engagement process.

FIGS. 4, 5, 6 and 7 illustrate in sequence how the first and second end segments 26 and 28 are engaged and retained by the binding 44. For reference, the bale-shaped dashed lines in each of FIGS. 5–7 are included as indications of the position of the bale position displayed in each preceding figure. As illustrated in FIG. 4, the end segment 26 is first placed over the cross bar 58 connected to hook member 52 through opening 42, and lowered into engagement with the surface 122 as shown in FIGS. 4 and 5, moving from a first portion as indicated by dashed lines at 117 to a second portion at 119. The boot 12 and bale segment 28 are then rotated in the clockwise direction so that the segment 28 engages surface 110 of latch 76, rotating it counter-clockwise from a position indicated by dashed lines at 121 to a second portion at 123, and to engage cam surface 72. Surface 110 is trough-shaped in the preferred embodiment, which configuration tends to temporarily guide the bale segment 28, keeping it from slipping off to the left of bar 70, and also aiding in transferring the downward thrust of the bale segment 28 to rotational movement of the latch 76.

As segment 28 moves downward and outward as shown in FIG. 6 from a position 125 indicated by the dashed lines to a position 127, the cam surface 72 causes the bale to be drawn rightwardly as indicated by arrow 132, so that segment 26 is pulled from position 134 to position 136 into hooked engagement with hook members 52, 54. Note that as segment 28 moves down the surface 72, it also moves past the tip 138 of latch 76 as the latch is rotated out of the way from a first position at 131 to a second position at 133.

Figure 7A:
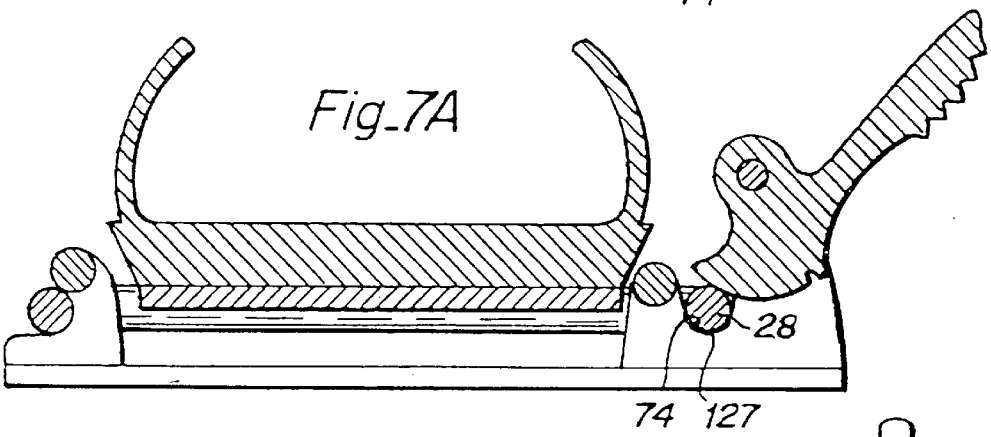
FIG. 7*a* is a simplified view of the view shown in FIG. 7.

In FIG. 7, end segment 28 has slipped by the latch tip 138 from position 135 indicated by dashed lines to position 137, and end segments 26 and 28 are shown fully engaged with the binding 44. In this position segment 28 rests fully in the notch 74, and segment 26 is pulled fully into the hooked recess 60. Note that when segment 28 passes the tip 138, the latch moves from position 139 to 141, rotated by spring 88 into its latching position with surface 118 engaging the top of end segment 28. In this position the bale is fully captivated in the binding 44. Any tendency toward upward motion of the segment 26 is resisted by the hooked members 52, 54, and any tendency toward upward motion of the segment 28 is resisted by the latch 76. The location of the axis 116 above and slightly outward from the notch 74 is an important design parameter in securing the segment 28. In this position at 141, any upward force on the second segment 28 will exert a force component against the surface 112 primarily towards the axis 116 which does not tend to rotate the latch 76. Due to the axis being slightly outward from the notch 74, a minor component of force is also exerted tangentially to the surface 112 tending to rotate the latch clockwise, but due to the progressive increase in the distance of the camming surface 112 from the axis 116 as above described, such motion causes the segment to be more firmly compressed between the surface 112 and notch 74 due to the portion of surface 112 with increased radius being forced into contact with the segment 28. Also, the shape of the opening 143 between the surface 112 and surface 72 resists movement of the segment 28. FIG. 7 also shows that if the latch is held in position 139, there is a gap 123 between the segment 28 and surface 112 when the segment is fully engaged in the notch 74. This again is a result of the camming shape of surface 112, and makes it possible for the latch 76 to adjust for variations in the resting portion of the segment 28 in its notch, allowing it to firmly secure the segment 28 even if there is snow or ice under the boot such as at 125 holding it up from the frame 48, or ice in the notch 74 holding the segment up. If the ice or snow compresses after initial latching, the latch will automatically rotate clockwise due to spring 88 forcing the surface 112 to maintain contact with the segment 28. This feature is perhaps more clearly shown in FIG. 7*a* which shows the binding in a position with a slight gap 127 between the segment 28 and the bottom of the notch 74.

Figure 8:
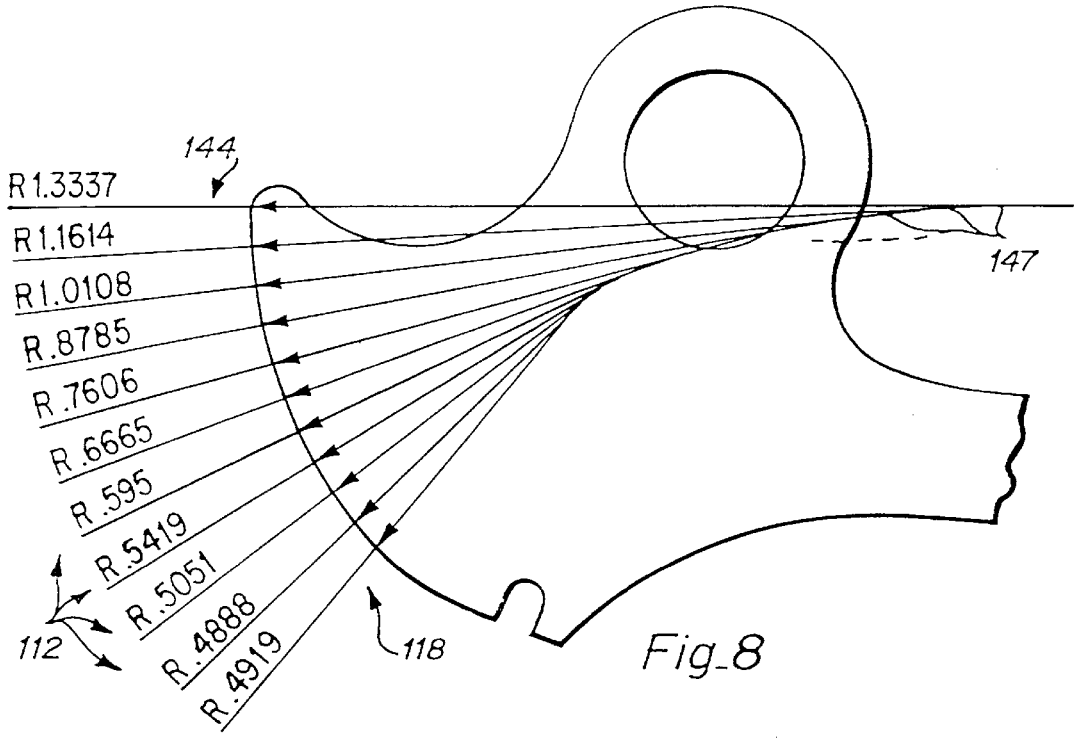
FIG. 8 gives detail of the shape of the latch bale engagement surface.

FIG. 8 gives a more detailed description of a preferred contour for the cam latch surface 112 showing the upper surface 114 having a much longer radius of curvature than the lower surface 118. Each of the multiplicity of line lengths 147 represents the radius of the surface 112 at the point intersected by the line. It should be noted that this information on the surface 112 curvature is in addition to the description above in relation to FIG. 4 which details the surface 112 position relative to the axis 116.

Figure 9:
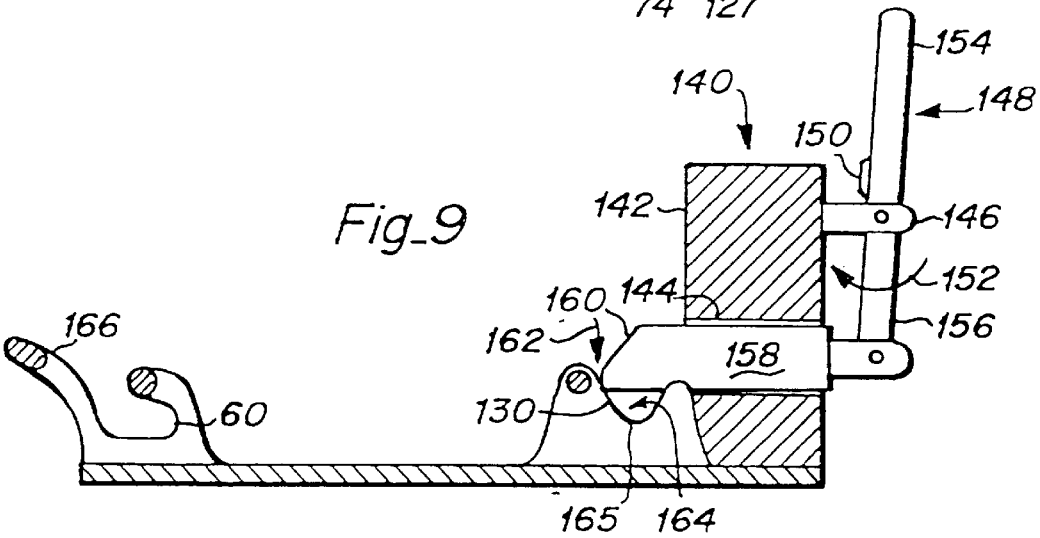
FIG. 9 illustrates an alternate embodiment of the present invention including a latch with a spring loaded rod assembly.

Referring now to FIG. 9 of the drawing, there is shown an alternate form of latch apparatus 140 for captivating the end segment 28 (not shown) within the notch 74. This embodiment includes a block 142 shown in cross-section with bore or other passageway 144 passing therethrough. The block has a bracket 146 extending outward therefrom upon which a lever 148 is hinged and urged by a spring 150 to rotate in the direction indicated by the arrow 152. The lever 148 has a first end 154 serving as a handle to enable the user to release the latch, and a second end 156 hinged to a latching pin or bar 158 having a tapered end 160 upon which end segment 28 (not shown) may bear against during the process of engaging the bale with the binding as the end segment 28 moves in a downward direction as indicated by arrow 162, urging the pin 158 rightwardly against the force of the spring 150, and camming along the surface 130 to the rest position 164 in the notch 165. This embodiment may also include the addition of an optional bale-guiding member 166 which would serve to assist in the initial registration of the bale with the binding 44. Other latch configurations for capturing the bale within the notch 165 will no doubt also be apparent to those who are skilled in the art, after having read this disclosure, and are included as within the spirit of the present invention.

Figure 12:
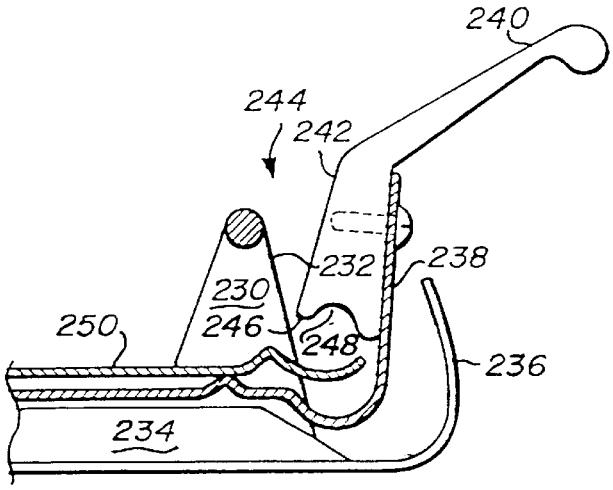
FIG. 12 is an illustration of a latch including a handle attached to the base by a spring.
Figure 10A:
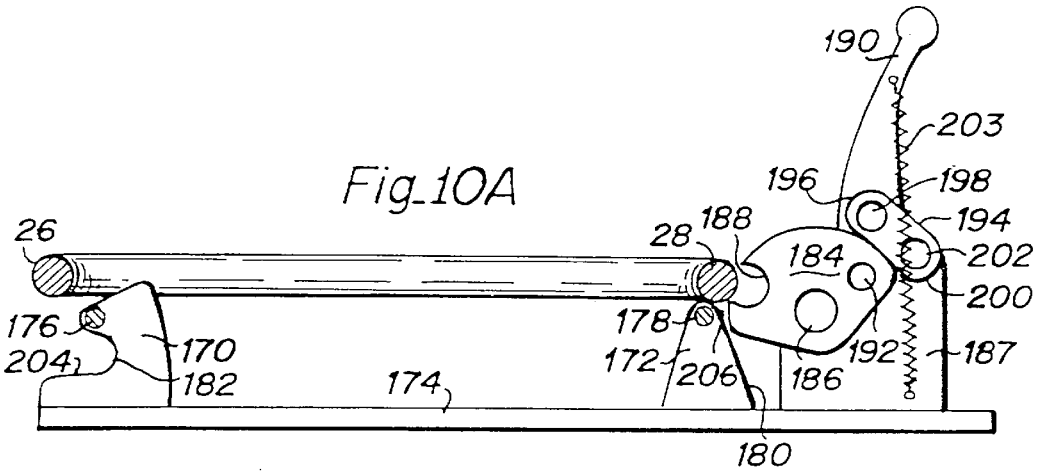
FIGS. 10A and 10B show an alternate embodiment of the latch including a pivoted block and handle assembly with the bale positioned for engagement in FIG. 10A and at full locking engagement in FIG. 10B.
Figure 10B:
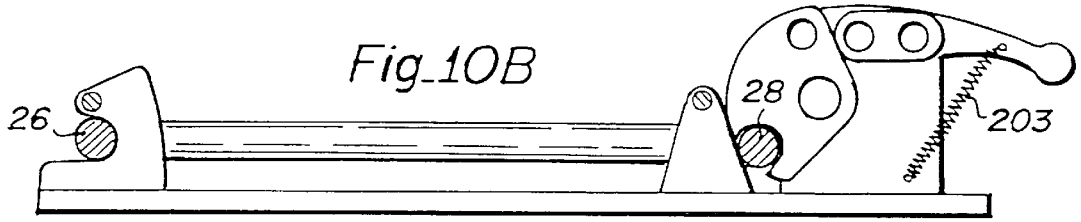

Other alternate embodiments of latching mechanisms are shown in FIGS. 10–12. FIGS. 10A and 10B show a binding with an outwardly hooked member 170 for receiving the bale end segment 26. Opposite the hooked member 170 there is a saddle shaped extension 172 extending upward from a base plate 174. The general structure of the hooked member 170, base plate 174 and member 172 is similar to that of FIGS. 2–7, the hooked member 170 and saddle shaped extension 172 each being one of a pair mounted on or formed from the base or frame 174 and joined together by cross bars 176 and 178. For simplicity of depiction, only a planar side view is shown. In a similar manner to the apparatus of FIGS. 2–7, there is a downward and outwardly sloping surface 180 to guide segment 28 and cause segment 26 once contacting surface 204 to be pulled into the hooked recess 182 of hook 170.

The latching mechanism includes a captivation block 184 pivotably mounted on pin 186 to a support plate 187, with a semicircular recess 188. A handle 190 is pivotably mounted on pin 192 at a first end to one side of block 184 at a distance from the pin 186. The handle is also pivotably joined to the plate 187 by a doubly pivoted member 194 having a first end 196 joined to the handle 190 by pin 198 and a second end 200 pivotably joined to the plate 187 by pin 202. Once the segment is in the latched position as shown in FIG. 10B, the handle 190 is restrained by spring 203 from moving up to the release position of FIG. 10A.

FIG. 10A shows the block 184 rotated by handle 190, placing recess 188 upward in a position to accept segment 28 therein. A downward movement of the segment 26 places it in contact with surface 204, and a similar downward thrust of segment 28 causes it to be guided by surface 206 into recess 188, causing the rotation of block 184 counter clockwise as viewed in FIG. 10, which rotation moves handle 190 and member 194 into the position as shown in FIG. 10B, being locked into position in that an upward thrust on segment 28 is resisted by the orientation of the handle 190 and member 194.

Figure 11A:
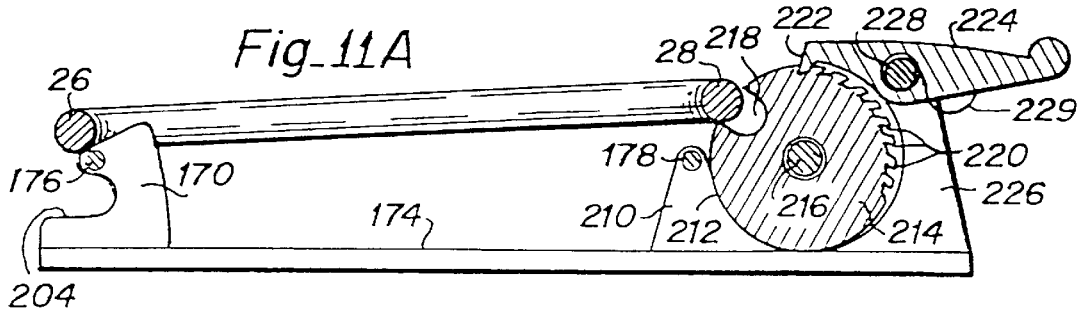
FIGS. 11A–11C illustrate another embodiment of the latch including a notched wheel with a recess for receiving the bale.
Figure 11B:
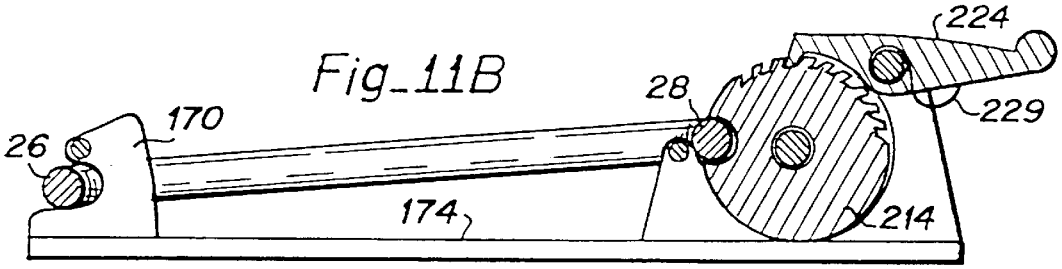
Figure 11C:
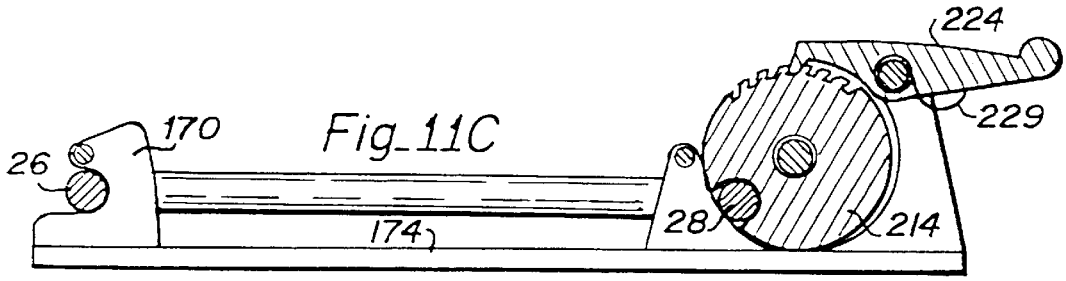

The apparatus of FIGS. 11A, 11B, and 11C illustrates another latching mechanism. As in FIG. 10, there is a pair of hooked members 170 extending from a base plate 174 joined by a cross bar 176, and opposing saddle shaped extensions 210 joined by a cross bar 178, the extensions 210 having downward and outwardly extending surfaces 212 for guiding the second bale segment 28. The latch consists of a circular member 214 mounted on axle 216 to a support plate extending from the base 174 but not shown. The circular member has a semicircular cut out 218 for engaging the segment 28, and has a number of locking indents 220 which cause the member 214 to be captivated from moving in a clockwise direction when the prong 222 of a pivotably mounted handle 224 is lodged therein. The handle is pivotably mounted to support 226 by pin 228. A spring 229, similar to spring 88 of FIG. 3 is mounted to handle 224 and axle 228 to urge the prong 222 into the recesses 220. FIGS. 11B and 11C show the bale segments 26, 28 and circular member 214 in an intermediate position and a final locked-in position respectively.

FIG. 12 shows a latching mechanism, again working with a saddle shaped member 230 extending up from a base 234 and having a downward and outwardly sloping surface 232. The base 234 has a stop extension 236 for restricting the movement of a resilient, primary spring member 238 upwardly curving from the base 234. A handle 240 is bolted to the member 238 and has an upward and outwardly lying surface 242 forming a wedge shaped opening 244 between the surface 242 and surface 232 for capturing and guiding segment 28 down along the surface 232 until it reaches the bottom 246 of the handle 240, at which point the resilient primary spring 238 snaps back over the segment 28 capturing it in position in semi-circular groove 248. The segment rests on a secondary spring 250 attached to the base and configured for urging the segment upward against the groove 248.

Figure 13:
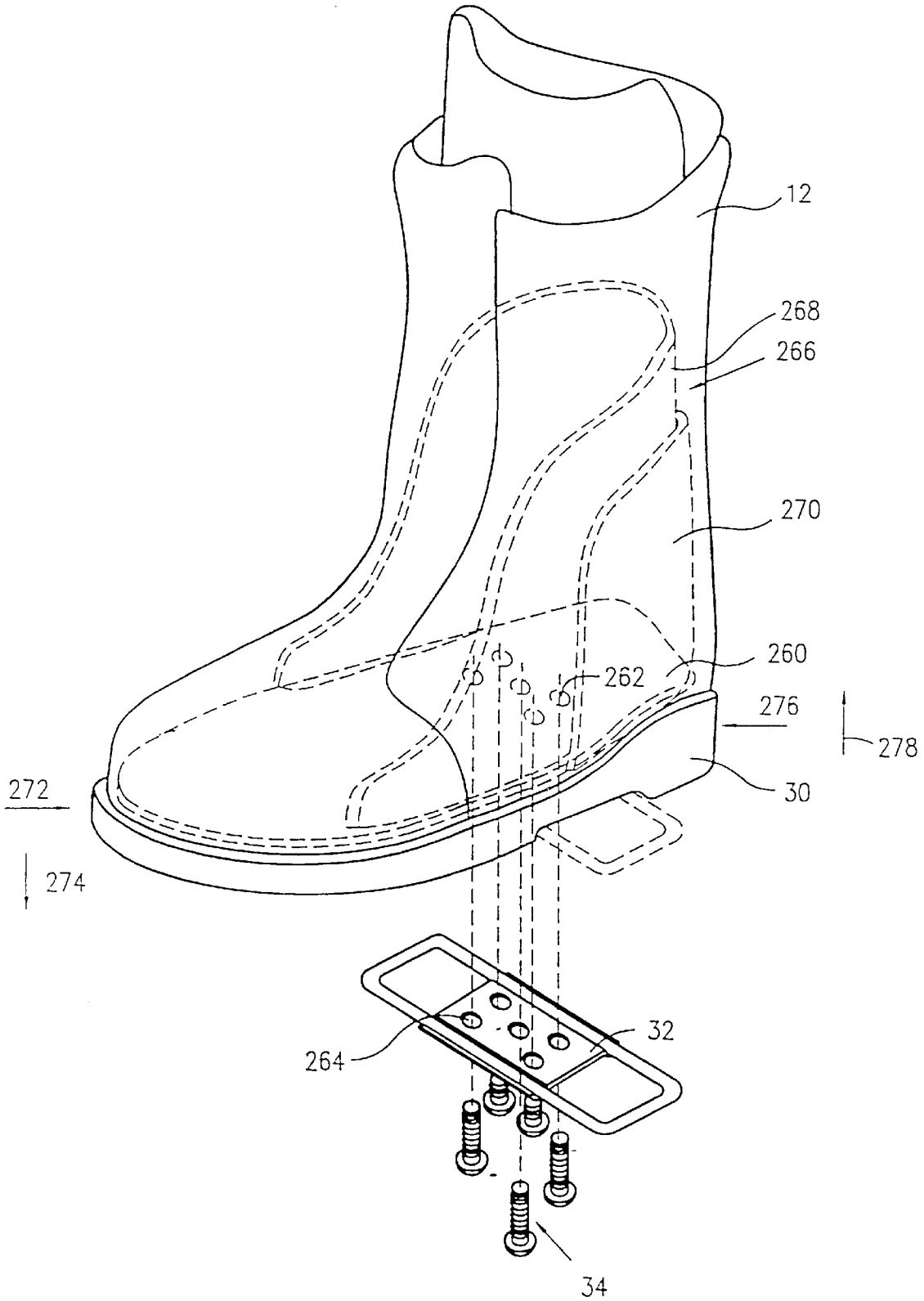
FIG. 13 is a perspective view of a boot equipped with an adjustable foot support and bale element.

FIG. 13 is a perspective view of a boot 12 equipped with an adjustable insert 266, and a shank plate 260 positioned on the inside so as to give rigidity to the sole 30.

The plate 260 has tapped holes 262, or alternately tapped lugs attached (not shown), into which bolts 34 are secured, passing through clearance holes 264 in retaining plate 32 and corresponding holes (not shown) in the boot sole 30, for rigidly compressing the bale 28, plate 32 and plate 260 to the sole 30.

The adjustable insert 266, includes an insert body 268 and insert riser 270, held together by means not shown in FIG. 13, but which will be fully described in the following figures of the drawing.

With a skier's foot secured in the boot 12 by boot buckles or laces, etc. (not shown), the insert 266, plate 260 and boot 12 combine to give rigid support to the skier's foot and ankle. The benefit is that when the skier leans forward, pressure is applied to the toe end 272 in a downward direction 274, and the heel end 276 tends to rise (direction 278). Similarly, when leaning backward, the toe rises and heel is pressured downward. Referring back to FIG. 1, it can be seen that these motions would apply pressure to one or the other of the edges of the snowboard. The advantage of the rigid support to the foot and ankle is that the skier does not have to use his leg and foot muscles to hold the ankle rigid relative to the toes in order to shift the pressure effectively from toe to heel. The removable insert 266 further allows the snowboard skier the choice of hard boot or soft boot performance, simply by removing or installing the insert 266. Alternatively, if the sole 30 is already fairly rigid, the system will function as above described without the plate 260, i.e., with the boot and binding assembly of FIG. 2 with the insert 266.

The angle between the bottom of a skier's foot and leg or ankle is another variable that the skier has a need to adjust according to his or her preference. This feature is provided by the two piece insert 266, the riser part 270 positionable relative to the body 268. The riser 270 is attached to the body 268 by any of various means well known to those skilled in the art of securing plates or fabrics together. The preferred embodiment uses semi-permanent, detachable adhesive type materials such as the product VELCRO, the position of which will be fully described in the following figures of the drawing.

Figure 14:
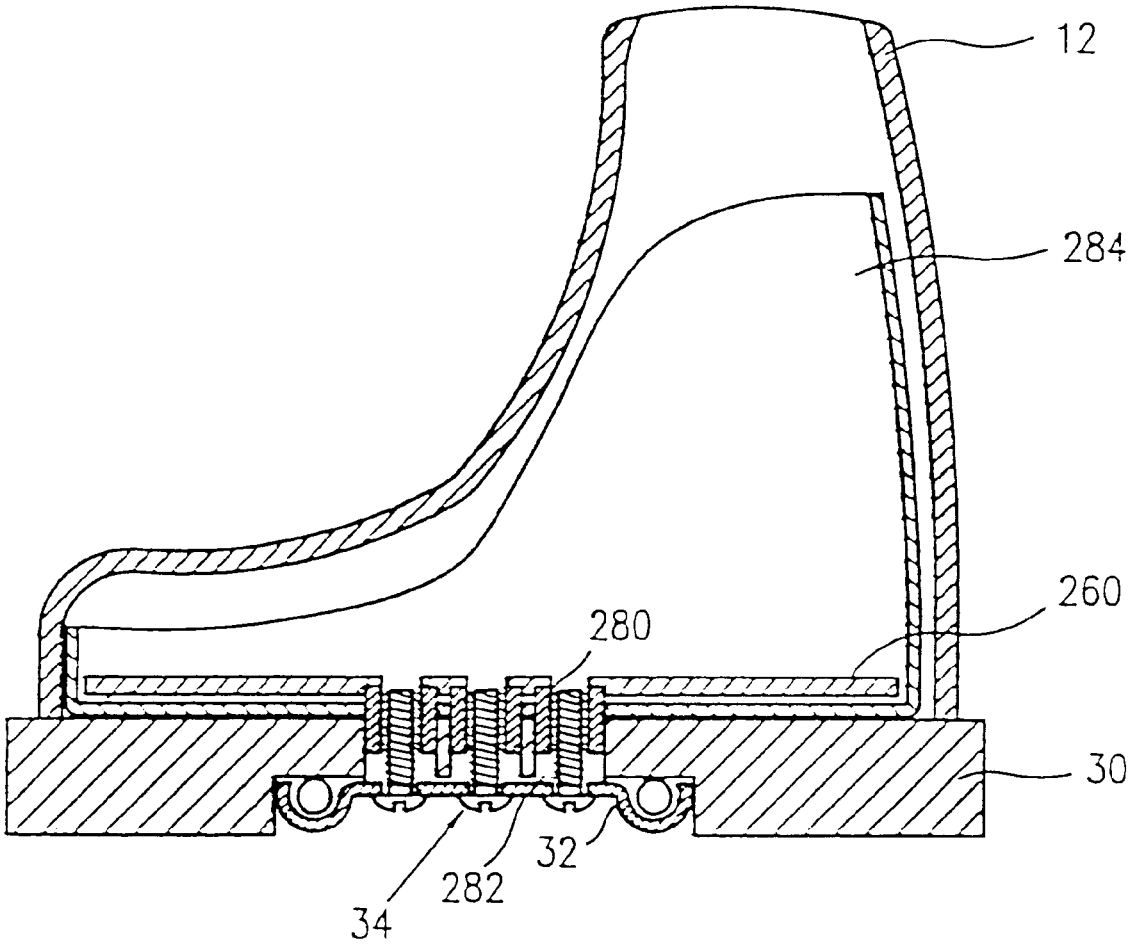
FIG. 14 is a sectional view of a boot with an insert of fixed configuration, mounted with a shank and bale element.

FIG. 14 gives further detail of the interconnection of plate 260 to plate 32. Tapped lugs 280 are shown attached to the plate 260, for receiving bolts 34 through holes 282 in the sole 30. Although bolts 34 and tapped lugs 280 are shown, there are many other ways of securing the plate 260 and bale assembly to the sole and/or to each other known to those skilled in the art, and these are to be included in the spirit of the invention. The interconnection can be either permanent or non-permanent. A permanent assembly of plate 260 to sole 30 would apply most appropriately with the use of the adjustable insert 266 or a non-adjustable insert placed on top of the plate 260. A non-permanent assembly as specifically detailed in FIG. 14 would be most useful with an insert as shown, the bottom of which is sandwiched between the plate 260 and sole 30.

The alternate embodiment with the insert 284 sandwiched between the plate 260 and sole 30 gives a greater rigidity to the system, at the expense of ease of user modification of the insert support structure. The invention includes both the easily removable insert 266, and the less easily removable or permanent type of insert 284.

Figure 15:
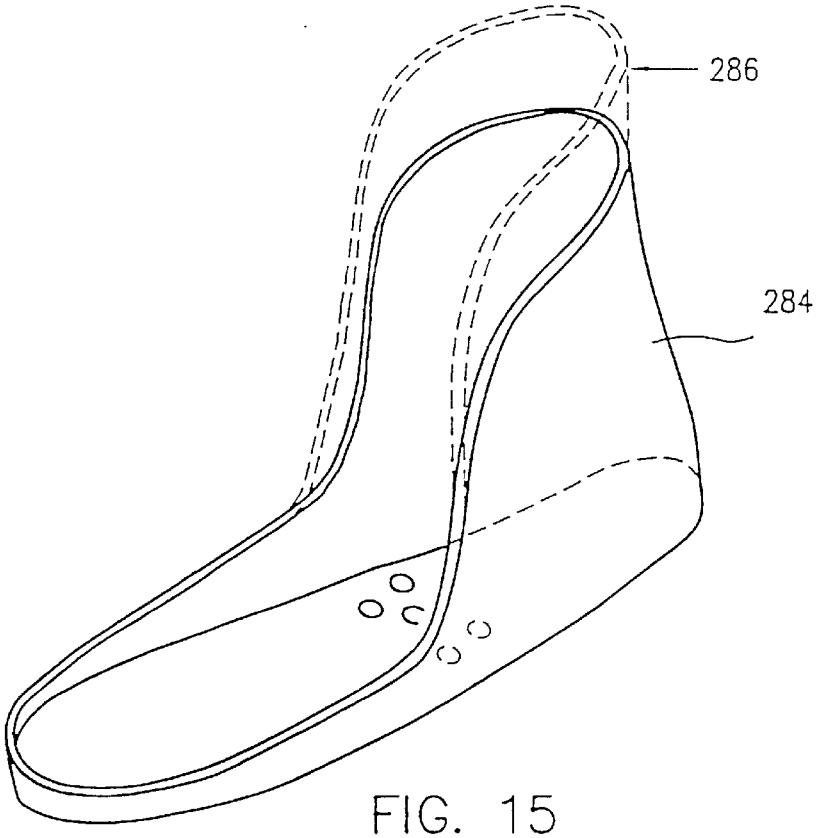
FIG. 15 is a perspective view of the insert of FIG. 14.

The non-adjustable insert 284 is shown in perspective view in FIG. 15. The dashed lines 286 indicate that the shape of the insert can be of various forms. A skier could purchase a number of different inserts which he could select from and install according to his particular requirement.

Figure 16:
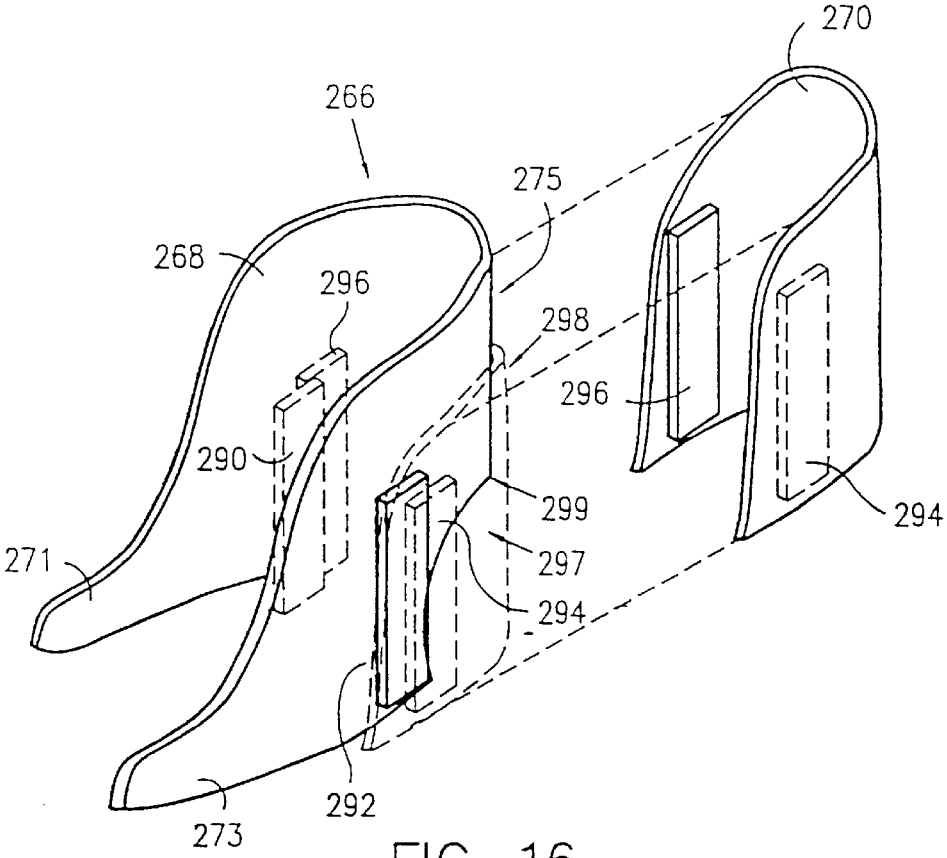
FIG. 16 is a perspective view of an adjustable, removable foot support.

FIG. 16 shows a more detailed view of the adjustable insert 266. The body portion 268 has first and second sides 271 and 273, and a back portion 275. Two adhesive elements 290 and 292 are shown, one attached to each of the two sides of the body 268. The insert riser 270 is shown to have corresponding pads 294 and 296 located on the two opposing inside surfaces. The dotted lines 298 indicate the insert riser 270 attached to the body 268 with pads 296 and 294 in adhesive contact with pads 290 and 292.

The body 268 has an optional cutout 297, allowing for more flexibility in the positioning of the riser insert 270, and allowing a skier's heel to project through.

Figure 17A:
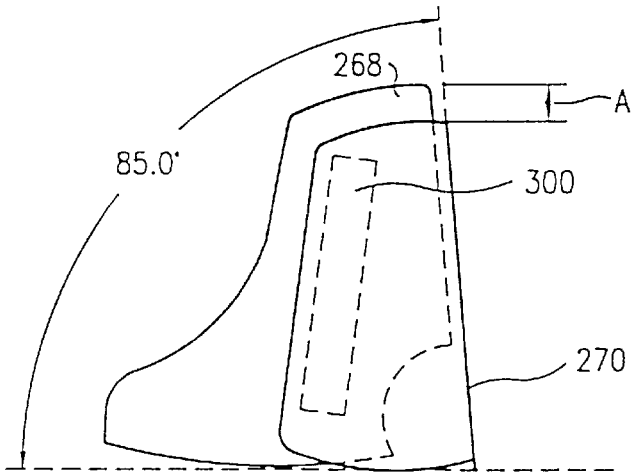
FIGS. 17A, 17B and 17C are side views of the adjustable foot support of FIG. 16 adjusted at various angles.
Figure 17B:
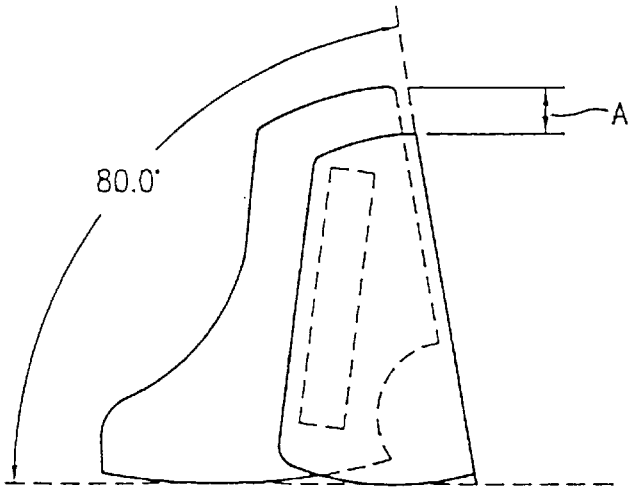
Figure 17C:
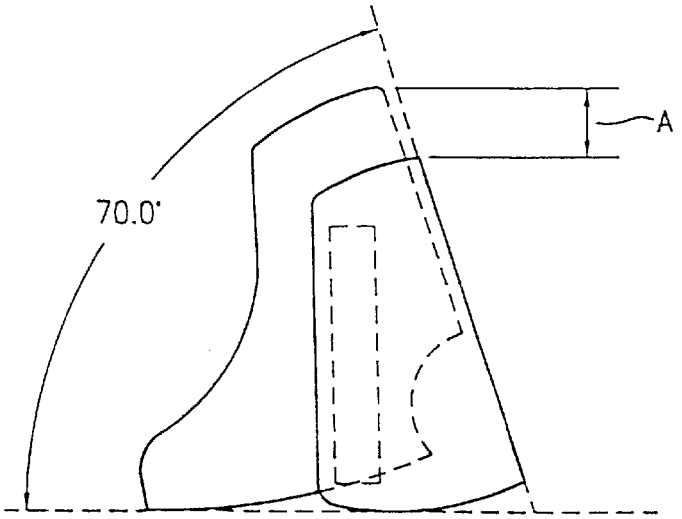

Various positions of the adjustable insert are illustrated in FIGS. 17A, 17B, and 17C, showing a nearly upright position at an angle of 85° between the plane of the boot sole and the axis of the skier's leg in FIG. 17A to a substantial forward lean at 70° in FIG. 17C. The invention, of course, is not limited to this range of adjustment. The adhesive pads 290, 292, and 296 shown in FIG. 16 are symbolically represented by the single rectangle 300. In practice the pads 290 and 292 will not usually be in complete alignment with the pads 294 and 296, the position being dependent on the location of the riser insert 270 relative to the body 268, indicated by the distance "A" between the top of the body 268 to the top of the riser 270.

Figure 18:
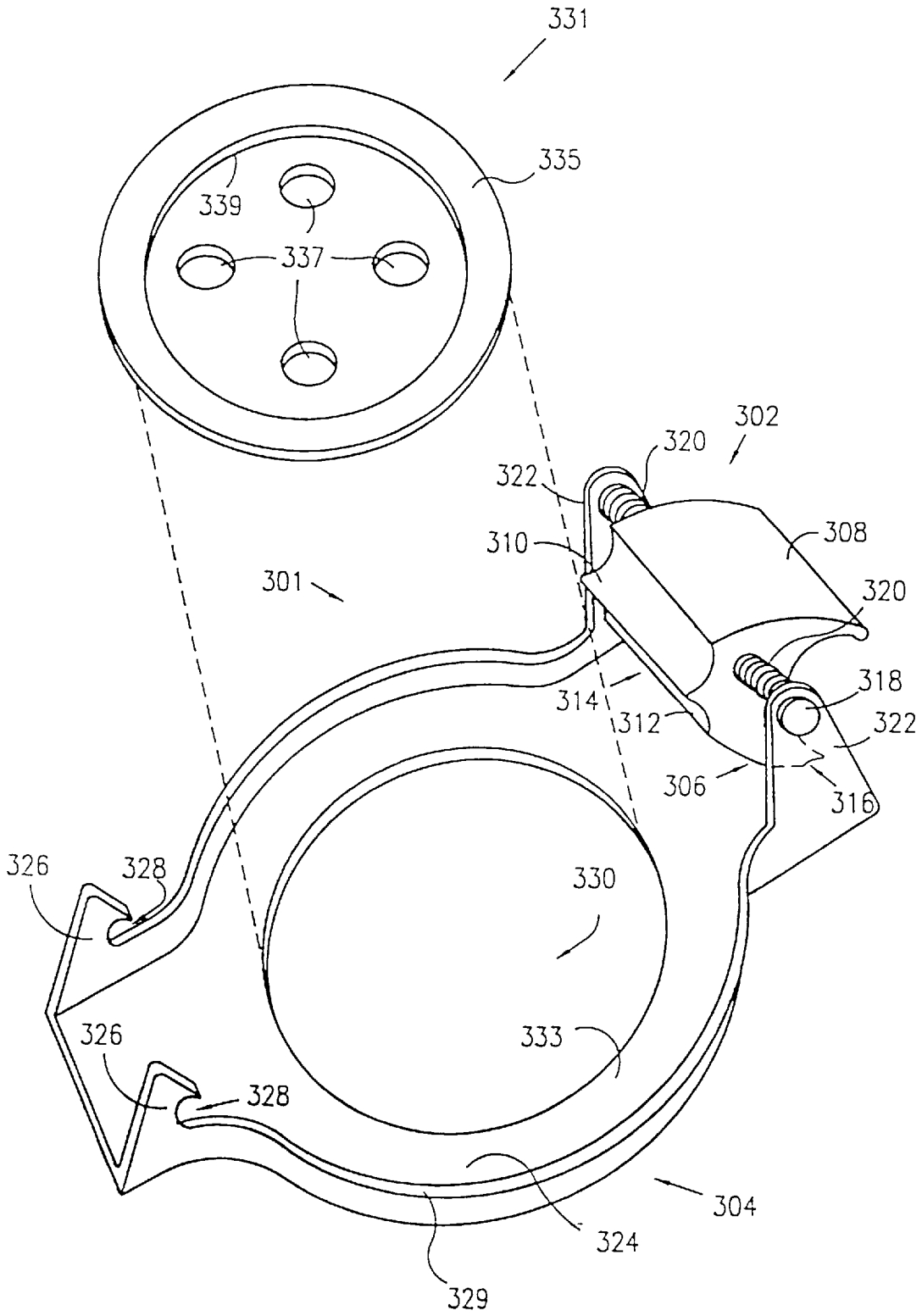
FIG. 18 is an alternate embodiment of a binding assembly having inwardly directed hooked shaped members.

FIG. 18 shows a binding 301 illustrating alternate latch 302 and frame 304 embodiments. The latch 302 is not limited in application to the frame 304 of FIG. 18, but can also be used instead of latch 76 on the binding 44 of FIG. 2. There is a latching surface 306 on latch 302, similar to the surface 112 of latch 76 illustrated in FIG. 4. Latch 302 also has a handle 308, and a trough shaped upper surface 310, but differs functionally from latch 76 in having a trough shaped recess 312 in an upper first portion 314 of the latching surface 306. A lower second portion 316 has a shape similar to the second portion 118 of latch 76 described in detail in FIG. 8. The purpose of the recess 312 is to provide a more secure bale element captivation in the event of a large amount of snow or ice buildup on the frame. This will be fully explained in the description of the following figures of the drawing.

The latch 302 is shown mounted on cross bar 318 attached to two upright members 322, located on one side of the frame 304 for supporting the latch 302 above platform 324 of frame 304. Springs 320 interconnect the latch 302 to the upright members 322 to urge the latch 302 in a clockwise direction.

On an opposite side of the frame 304, there are shown two inwardly directed hook shaped members 326 forming inwardly directed bale receiving recesses 328. A narrow edge 329 adds support to the frame 304 and serves as a high pressure bearing surface for the bale segments.

The frame 304 can be mounted to a snowboard by various means. FIG. 18 illustrates one such method. There is a large circular opening 330 in the frame 304. A cap plate 331 is configured to fit over the hole 330 and clamp the edge 333 of the frame with edge 335 of the cap plate 331, when bolts (not shown) are inserted through holes 337 and into a snow board. The edge 339 is drawn to illustrate a circular protrusion of the cap plate 331 dimensioned for a close fit in hole 330 to provide lateral captivation of the frame 304. As in FIG. 2, a friction layer similar to item 49 made of rubber of other appropriate material can be placed and clamped between the frame 304 and snow board.

The operation of the binding 301 and latch 302 will be fully explained in the description of FIGS. 20A, 20B, 20C, 20D, and 20E.

Figure 19A:
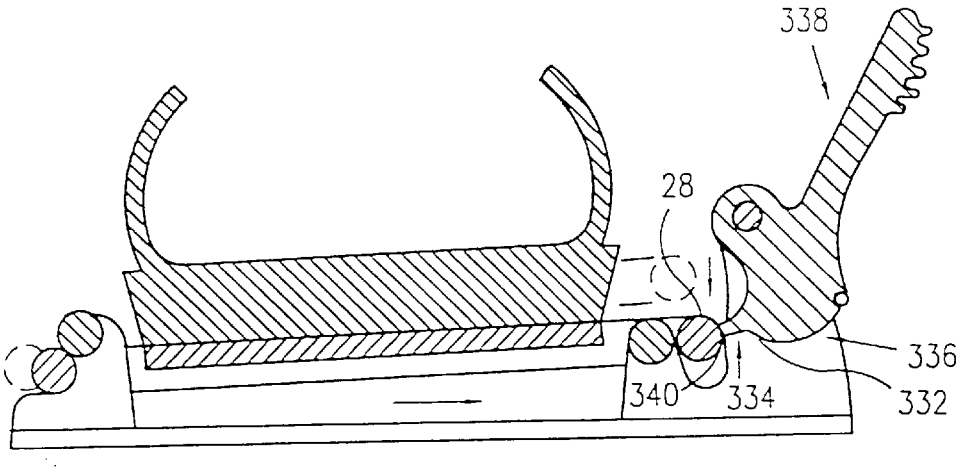
FIGS. 19A, 19B and 19C illustrate various stages of engaging a bale element with an alternate embodiment of a latch having a frontal recess, as part of a binding having outwardly directed hooked members.
Figure 19B:
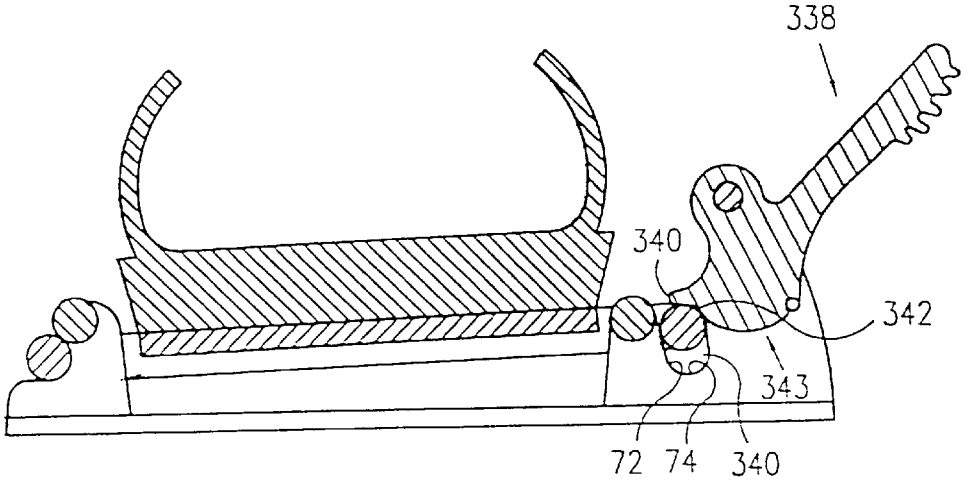
Figure 19C:
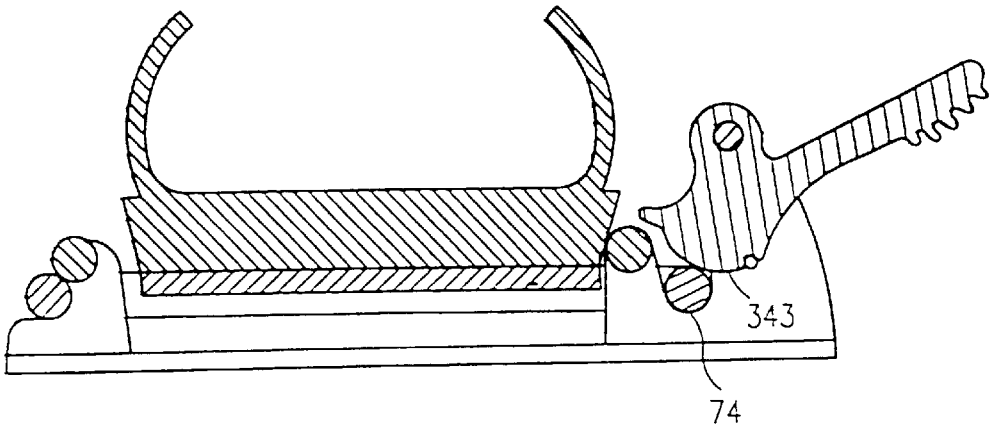

The latch 76 of FIG. 2 would be functionally the same as latch 302 if a recess similar to recess 312 were included. This configuration is illustrated in FIGS. 19A, 19B, and 19C which display the same components as in FIGS. 4, 5, 6, 7, and 7A, except for an alternate latch 338 having a recess 332 in the first portion 334 of surface 336. FIG. 19A shows the second bale-end segment 28 in a position where it has already depressed the latch 338 somewhat, and is about to pass by the tip 340. FIG. 19B shows the segment 28, having passed by the tip 340, allowing the latch 338 to rotate somewhat counter-clockwise to the point where the segment 28 is positioned in the recess 332. This is a secure position for the segment 28, and leaves allowance for a large amount of ice or snow build-up at 340. Any upward thrust of segment 28 will rotate the latch 338 clockwise, and cause the lower portion 342 of the recess 332 and/or a second, lower portion 343 of surface 336 to jam against the segment 28, forcing it against the camming surface 72 and resisting upward motion. As the ice and snow at 340 is compressed and forced out by the high pressure caused by the skier's weight and the narrow camming surface 72, the segment 28 will move downward into the bale-receiving notch 74 as shown in FIG. 19C. At the same time as the bale segment 28 moves downward, the latch will be allowed to rotate further counter-clockwise, resulting in the second portion 343 moving over the segment 28. At this point the forces on the bale segment 28 are the same as those described in relation to FIGS. 7 and 7A. The contour of the second portion 343 is operationally similar to that of the second portion 118 of FIG. 8.

FIGS. 20A, 20B, 20C, 20D, and 20E show how a bale assembly 350 is engaged with the binding 301. As the skier's foot (not shown) forces the bale assembly 350 downward, the first end segment 352 is placed on and guided inward by an inwardly sloping edge 354 of the hooked extension 326. The second end segment 356 is placed on the trough-shaped upper surface 310 of the latch 302.

Figure 20A:
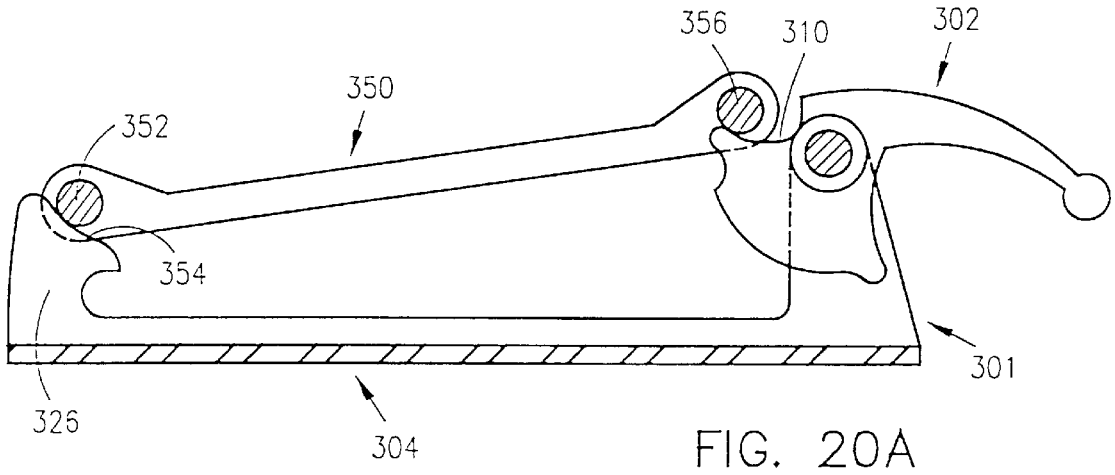
FIGS. 20A, 20B, 20C, 20D and 20E illustrate various stages of engaging a bale element with an alternate embodiment of a latch having a frontal recess, as part of a binding having inwardly directed hooked members.
Figure 20B:
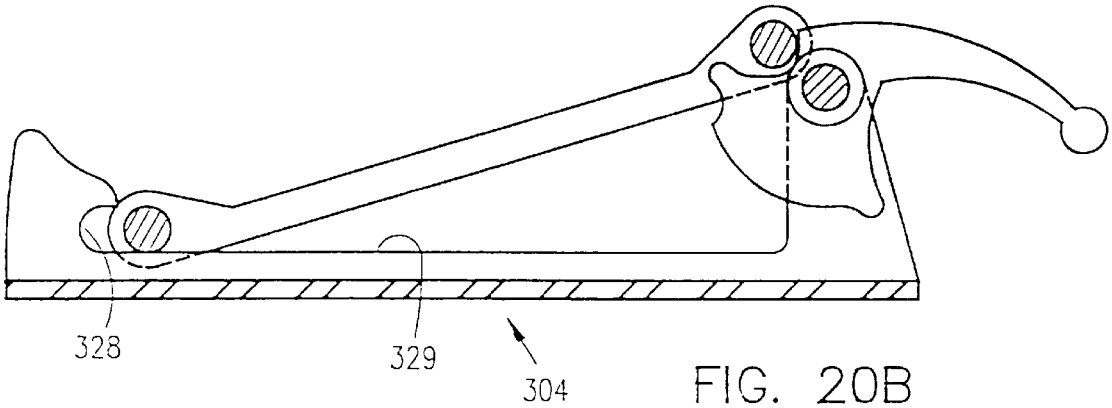

In FIG. 20B, the first end segment 352 is shown lying on the rim 329 of the frame 304, in position for moving into the bale-receiving recess 328.

Figure 20C:
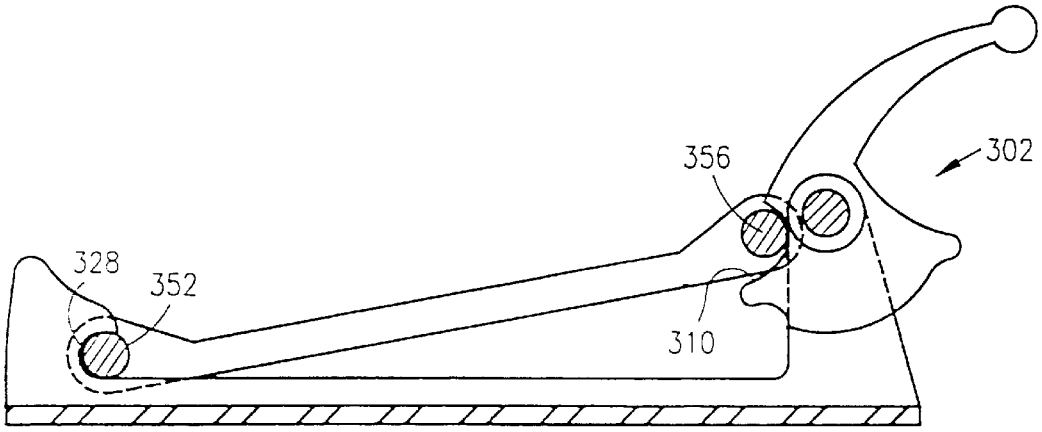

FIG. 20C shows the first end segment 352 in the recess 328, the force of the skier's weight having pressed the second end segment 356 against the surface 310 rotating the latch 302 counter-clockwise and the segment 356 downward.

Figure 20D:
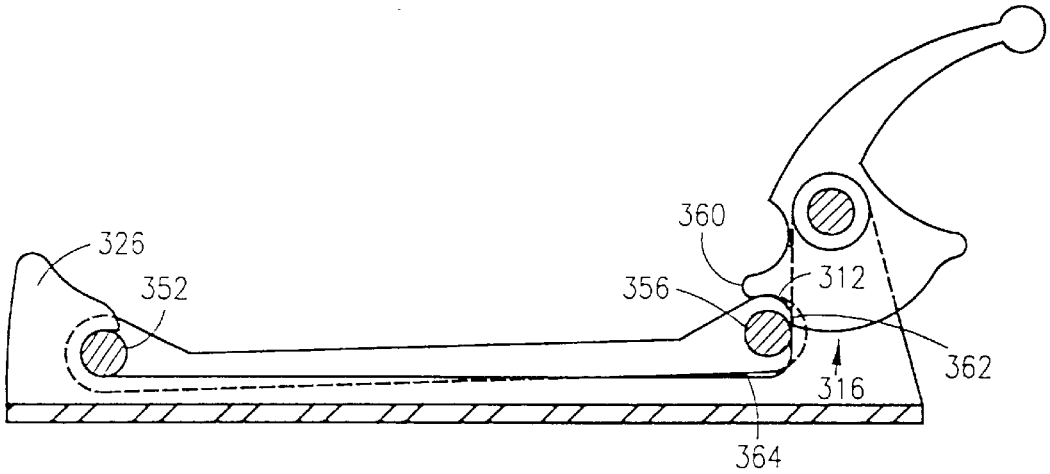
Figure 20E:
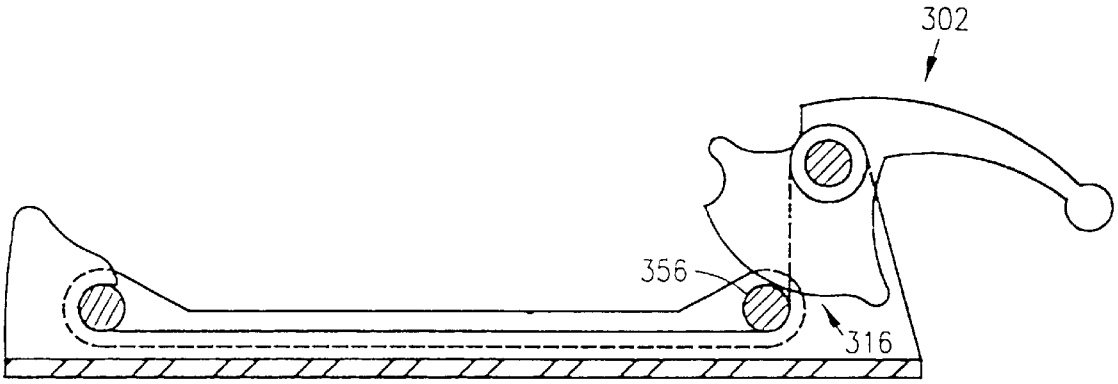

In FIG. 20D, the second segment 356 has moved past the tip 360 and is lodged in the recess 312. At this point, the segment 356 is restrained from moving back upward because such motion tends to rotate the latch clockwise, which causes the surface 316 or lower portion 362 of the recess 312 to move forcefully against the segment 356, forcing the first segment 352 against the hooked member 326, restraining movement in that direction. The surfaces of recess 312 and portion 316 are designed for contact with segment 356 to occur above the axis or center of the segment 356, therefore resisting upward movement. The recess 312 and rim 329 are preferably dimensioned so as to allow a gap 364 for a significant amount of ice or snow build-up. The skier's weight in combination with the narrow rim 329 then causes high pressure between the segments 352, 356 and the rim 329, crushing the ice and snow, causing segment 356 to move down further, the latch 302 finally being urged by spring 320 to move clockwise, positioning the surface 316 against the segment 356. This is shown in FIG. 20E. The principles of retainment at this stage are similar to those as discussed fully in relation to the latch 76. The forces of retainment in FIG. 20E differ from those explained in the description of FIGS. 7, 7A and 19C in that the retaining pressure from the latch to segment 356 is transferred to the hooked member 326 in the embodiment of FIG. 20E, whereas in FIGS. 7, 7A and 19C the pressure is transferred to the camming surface 72.

Although the latch 302 and frame 304 binding combination was described in detail above, the invention also includes the use of the other latches described in this specification with a frame having inwardly directed hooked members 326 as well as outwardly directed hooked members. Specifically, the latches include latch 76 of FIGS. 2 through 8, and the latches described in FIGS. 9, 10A, 10B, 11A, 11B, 11C, and 12. In addition, the invention includes other latch mechanisms in combination with the inwardly or outwardly directed hooked members. Other modifications in structure are also included, such as a cross bar added for support between the hooked members 326. Similarly, the binding as described in FIGS. 2 through 7A would be functional without the cross bars 58 and 70, and this modification is included in the spirit of the invention. Also, any number of hooked members, upright members and camming surfaces, such as items 54, 66, and 68 can be used. The objective of providing a binding with a lack of cavities to collect ice and snow, and to provide high pressure bearing surfaces, as described in this specification can be achieved with such modifications, and they are included in the spirit of the invention.

Figure 21:
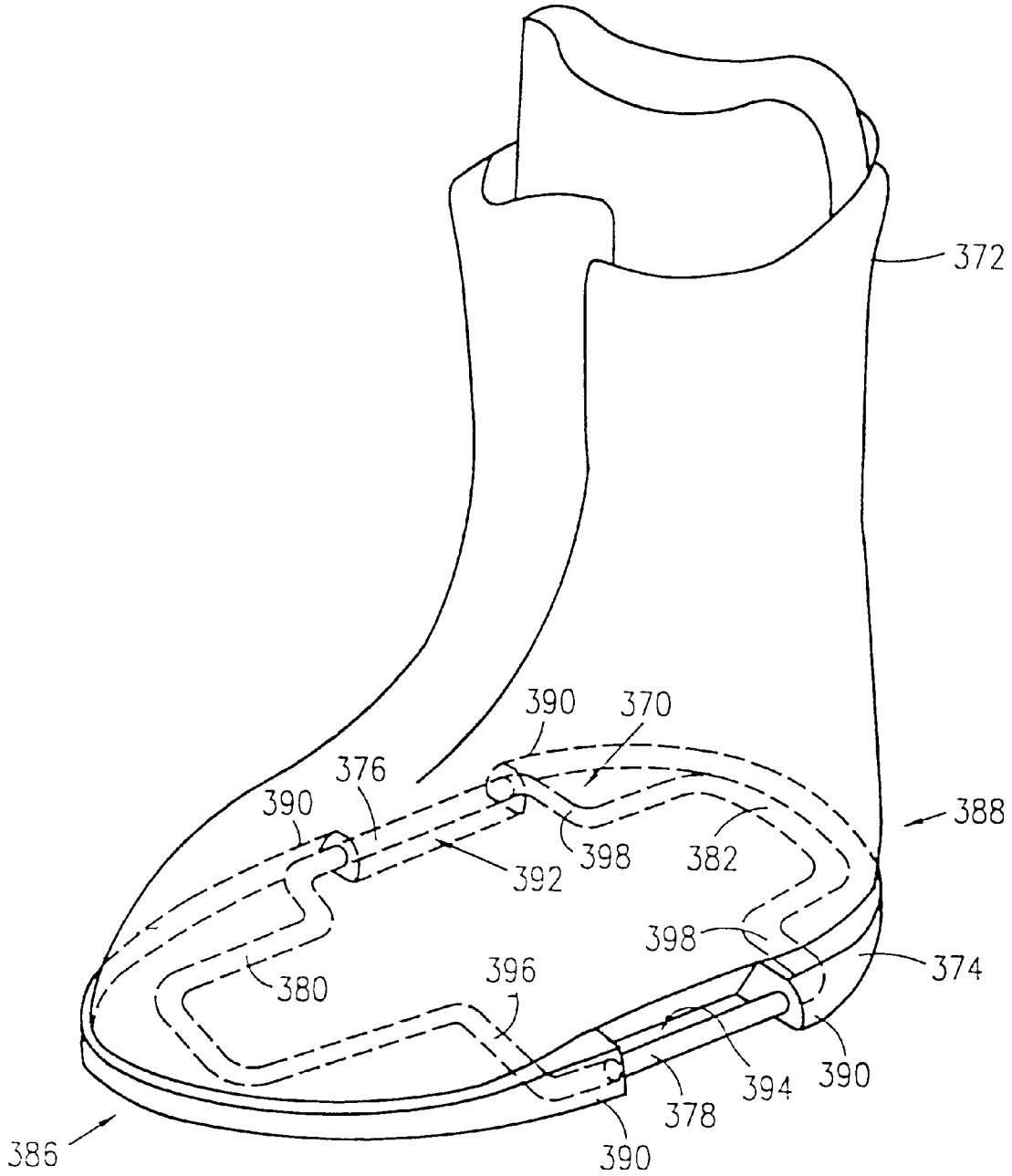
FIG. 21 illustrates an alternate bale and boot sole support apparatus.

FIG. 21 shows an alternative construction of the present invention including a contoured, closed loop bar 370 that serves the function of both the bale assembly 20 of FIG. 2, and the shank plate 260 of FIGS. 13 and 14. The bar 370 stiffens the boot 372 sole 374, and has segments 376 and 378, which perform the function as explained with regard to end segments 26 and 28 of FIG. 2.

Front and rear sections 380 and 382 extend within the sole 376 toward the boot toe end 386 and heel end 388. The boot as shown in FIG. 21 uses side extensions 390 of the sole 374 to define the openings 392 and 394. Alternatively, the sections 396 and 398 of the loop 370, extending into the boot could be relied upon to give end definition to the openings 392 and 394, in a similar manner to the bale assembly of FIG. 2. The sole 374 and bar 370 assembly of FIG. 21 can be fabricated using molding techniques well known in the art. The boot assembly of FIG. 21 is usable with all of the bindings and inserts described above. The embodiment shown in FIG. 21 is by way of example to show an integrated sole stiffener and bale assembly. Other methods of manufacture are also included in the spirit of the invention. For example, the stiffener portions of the loop 370 could be replaced by a plate molded into the sole, or it could be a grid of bars or a perforated plate, in each case integrally joined with extensions that connect with the end segments.

Figure 22A:
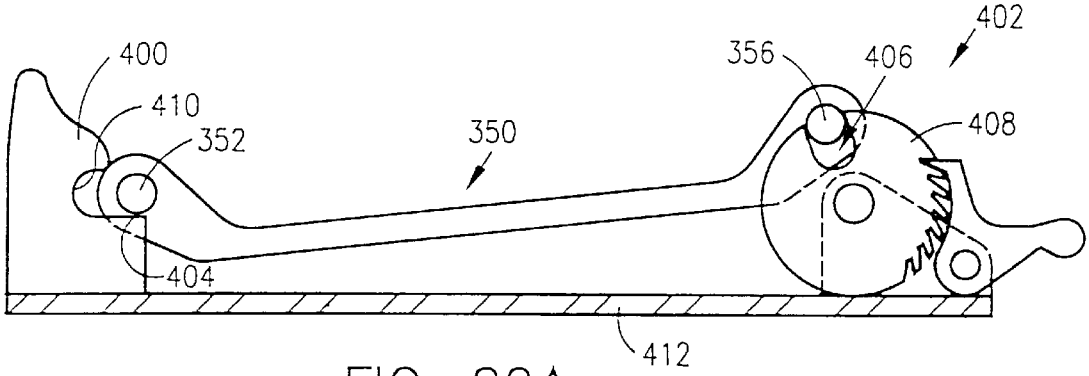
FIGS. 22A, 22B, 22C and 22D illustrate a wheel and prong latch with an inwardly directed hooked member.
Figure 22B:
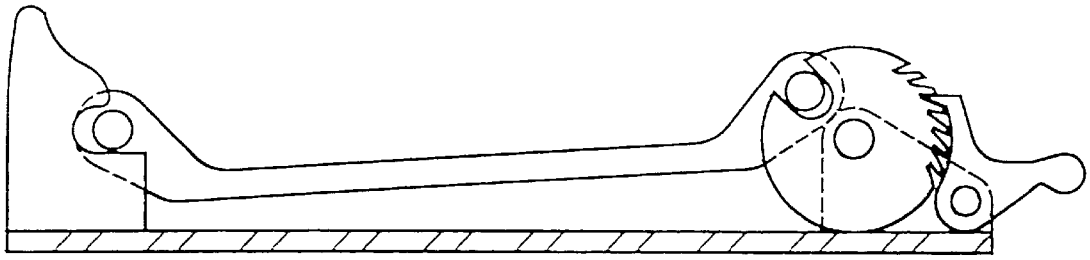
Figure 22C:
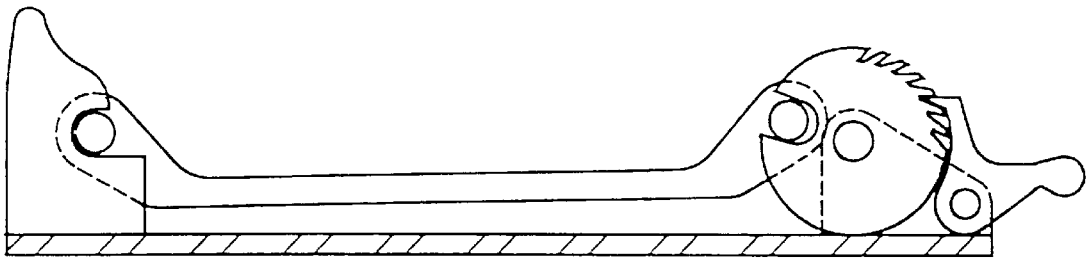
Figure 22D:
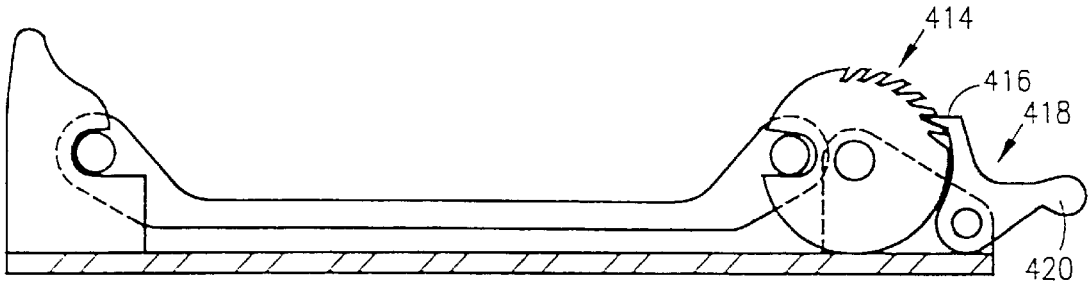

FIGS. 22A, 22B, 22C, and 22D show an alternate embodiment using an inwardly directed hooked member 400 with a latch 402 similar to the latch shown in FIGS. 11A, 11B and 11C. In FIG. 22A, the first end segment is placed on a ledge 404 and the second end segment is placed in the recess 406. Downward pressure on the bale assembly 350 causes the second end segment to rotate the wheel 408 counter clockwise, also moving the second bale element down and toward the hooked member 400. The motion of second end segment 356 is transferred to first end segment 352, moving it into the recess 410. The motion progresses as displayed in FIGS. 2B and 2C until the second end segment moves fully downward, limited by a rail (not shown) on the base 412. In this position, as shown in FIG. 22D, the first end segment is fully captivated by the recess 410, and the second end segment by recess 406. Upward motion is restrained by the locking indents 414 in engagement with a prong 416 of spring loaded lever 418. To release the bale assembly, it is merely necessary to push down on the handle 420, releasing the prong 416 from the indents 414.

Although a preferred embodiment of the present invention has been described above, it will be appreciated that certain alterations and modifications thereof will be apparent to those skilled in the art. It is therefore intended that the appended claims be interpreted as covering all such alterations and modifications as fall within the true spirit and scope of the invention.

What is claimed is:

1. A cam latch assembly for use in a binding that secures a boot to a snowboard, the binding having a frame for attachment to the snowboard, the frame having a member attached to a first side of the frame for captivating engagement in both vertical and horizontal directions of a first engaging element on a first side of the boot, wherein said cam latch assembly is attached to a second side of the frame opposite the first side of the frame, the cam latch assembly for captivating engagement in both vertical and horizontal directions of a second engaging element on a second side of the boot opposite the first side of the boot, the cam latch assembly comprising:

(a) a cam latch element pivotally mounted to rotate about a pivot axis between a latching position for restraining the second engaging element from movement and an unlatching position for releasing the second engaging element, the cam latch element including:

(i) a cam shaped engagement structure extending away from the pivot axis and having an engaging surface including an upper portion spaced a first distance from the pivot axis and a lower portion spaced a second distance greater than the first distance from the pivot axis;

(ii) a handle extending away from the pivot axis for use in rotating the cam shaped engagement structure about the pivot axis and into the unlatching position for releasing the second engaging element; and (iii) a spring for biasing the cam element about the pivot axis and toward the latching position; and (b) a pivot support for pivotally mounting the cam latch element about the pivot axis, the pivot axis located such that when the spring biases the cam latch element into the latching position, the engaging surface engages and restrains the second engaging element from movement.

2. The assembly of claim 1 wherein the engaging surface of the cam latch element is positioned closer to the boot to be secured than is the handle, so that when the handle is rotated upward the engaging surface rotates away from the second engaging element to allow entry and removal of the second engaging element.

3. The assembly of claim 2, wherein the cam shaped engagement structure includes a trough shaped recess for engaging the second engaging element when it is captivated by the latch.

4. The assembly of claim 2, wherein the cam shaped engagement structure includes a trough shaped upper surface for positioning the second engaging element before the second engaging element is captivated by the latch, and for permitting rotation of the latch to a captivating position when force is applied from the second engaging element to the trough shaped upper surface.

5. The assembly of claim 4, wherein the cam shaped engagement structure includes a trough shaped recess for engaging the second engaging element when it is captivated by the latch.

6. The assembly of claim 1, wherein the cam shaped engagement structure includes a trough shaped upper surface for positioning the second engaging element before the second engaging element is captivated by the latch, and for permitting rotation of the latch to a captivating position when force is applied from the second engaging element to the trough shaped upper surface.

7. The assembly of claim 1, wherein the cam shaped engagement structure includes a trough shaped recess for engaging the second engaging element when it is captivated by the latch.

8. The assembly of claim 7, wherein the cam shaped engagement structure includes a trough shaped upper surface for positioning the second engaging element before the second engaging element is captivated by the latch, and for permitting rotation of the latch to a captivating position when force is applied from the second engaging element to the trough shaped upper surface.

* * * * *